US005773560A

United States Patent [19]

Asami

[11] Patent Number: 5,773,560

[45] Date of Patent: Jun. 30, 1998

[54] SILVER HALIDE COLOR PHOTOGRAPHIC LIGHT-SENSITIVE MATERIAL AND COLOR IMAGE FORMING METHOD

[75] Inventor: Masahiro Asami, Kanagawa, Japan

[73] Assignee: Fuji Photo Film Co., Ltd., Kanagawa, Japan

[21] Appl. No.: 900,860

[22] Filed: Jul. 25, 1997

[30] Foreign Application Priority Data

Jul. 25, 1996 [JP] Japan ..... 8-196767

[51] Int. Cl.[6] ..... G03C 8/40

[52] U.S. Cl. ..... 430/203; 430/249; 430/254; 430/404

[58] Field of Search ..... 430/203, 249, 430/254, 404

[56] References Cited

U.S. PATENT DOCUMENTS

| | | | |
|---|---|---|---|
| 5,558,973 | 9/1996 | Yamada | 430/203 |
| 5,585,231 | 12/1996 | Yamada et al. | 430/203 |
| 5,716,775 | 2/1998 | Uehara et al. | 430/203 |

*Primary Examiner*—Hoa Van Le

*Attorney, Agent, or Firm*—Sughrue, Mion, Zinn, Macpeak & Seas, PLLC

[57] ABSTRACT

The present invention discloses a silver halide color photographic light-sensitive material which comprises a first support having thereon at least one photographic light-sensitive layer comprising a light-sensitive silver halide emulsion, a developing agent, a compound capable of forming a dye upon coupling reaction with an oxidation product of the developing agent, a binder, and a mercaptoazole compound, and a color image forming method comprising imagewise exposing the above-described silver halide color photographic light-sensitive material, supplying water to the light-sensitive material or a processing material comprising a second support having thereon a base or a base precursor, in an amount ranging from 1/10 to the equivalent of an amount which is required for the maximum swelling of the all coated layers of these materials, placing the light-sensitive material and the processing material face to face, and heating the materials at a temperature of 60° to 100° C. for a period of 5 to 60 seconds to form a color image. The present invention provides a light-sensitive material and a color image forming method characterized by high sensitivity and an insignificant fogging level.

10 Claims, No Drawings

SILVER HALIDE COLOR PHOTOGRAPHIC LIGHT-SENSITIVE MATERIAL AND COLOR IMAGE FORMING METHOD

BACKGROUND OF THE INVENTION

1. Field of the Invention

The present invention relates to a novel silver halide color photographic light-sensitive material for recording images in color photography and a color image forming method utilizing the said light-sensitive material.

2. Description of the Related Art

Owing to remarkable development of light-sensitive materials utilizing silver halides, high-quality color images are now easily obtainable. For example, according to ordinary color photography, a color print is obtained by the process comprising taking a photograph utilizing a color negative film, developing the film, and printing the image information, which is recorded in the color negative film, on color photographic paper in an optical way. Recently, this process has made remarkable progress, and large-scale, color development laboratories, in which a large quantity of color prints are produced in a very efficient way, have spread along with the so-called mini-laboratories which are now in shops and are designed to provide small-scale, handy printer processing. Therefore, anybody can enjoy color photography easily.

The color photography, now in common use, reproduces color by the subtractive color process. Generally, a color negative film comprises a transmittable substrate and light-sensitive layers thereon utilizing a silver halide emulsion as a light-sensitive component having a sensitivity to the blue, green or red wavelength region of light, and a so-called color coupler capable of producing a yellow, magenta or cyan dye as a complementary hue of the sensitive wavelength region of the layer. A color negative film, which has been exposed while taking a photograph, is developed in a color developer containing an aromatic primary amine developing agent. In this process, the developing agent develops, i.e., reduces the exposed silver halide grains, and the oxidation product of the developing agent, which are formed concurrently with the forgoing reduction, undergoes the coupling-reaction with the color coupler to form a dye. The silver (developed silver) generated by the development and the unreacted (unexposed) silver halide are removed by means of a bleaching process and fixing process. This creates a color image on the color negative film. Consequently, a color photographic paper which comprises a reflective substrate and light-sensitive layers formed thereon having the same combinations of light-sensitive wave length region and hue to be produced as in the color negative film, through the developed negative film, and color-developing, bleaching and fixing the color photographic paper in the same manner as in the case of the negative film to obtain a color print having a color image as a reproduction of an original image thereon.

Although these systems are widely adopted at the present time, there is a growing demand for a simpler system. First reason for this is that expertise and skilled operation are necessary, due to the requirement of strict control of the composition and the temperature of the processing solution in a processing bath for the above-mentioned procedure consisting of color development, bleaching and fixation. Second reason for this is that closed equipment exclusively for the use in the developing process is often required, due to substances, such as a developing agent and an iron chelate compound, the discharge of which is regulated from the standpoint of environmental protection, contained as a bleaching agent in the processing solution. Third reason for this is that the currently available system does not perfectly fulfill the requirement for a rapid reproduction of image, as the above-mentioned developing process still requires a long time, although the time is shorted by the recent advance in technology. Based on this background, there has been a strong demand for a simpler system which does not utilize the developing agent and bleaching agent now in use for a conventional color image forming system and which accordingly minimizes the adverse effect on the environment.

As an attempt to fulfill the above-mentioned requirements, many improved techniques have been proposed. For example, IS & T's 48th Annual Conference Proceedings, pp. 180, discloses a system in which the dye formed in the developing reaction is transferred to a mordant layer and thereafter stripping a light-sensitive material from an image receiving material bearing the mordant layer to separate the developed silver and unreacted silver halide from an image formed by the dye without the use of a bleaching-fixing bath which has been indispensable to a conventional photographic process. However, this technique cannot perfectly solve the environmental problems, because it still needs a developing process by use of a processing bath containing a developing agent.

Fuji Photo Film Co., Ltd. has proposed a Pictrography System which dispenses with a processing solution containing a developing agent. In this system, a small amount of water is supplied to a light-sensitive material containing a base precursor which reacts with water to generate a base. The light-sensitive material and an image receiving material are placed face to face and heated to promote the developing reaction. This system does not use the aforementioned processing bath and, in this regard, is advantageous with respect to environmental protection.

This system, however, displayed a serious problem when rapid image formation was attempted on a photographic light-sensitive material having high sensitivity using the hot development which utilizes the above-mentioned base generating method. That is, an emulsion, which is contained in the photographic light-sensitive material and has high sensitivity, tends to cause fogging to such an extent that a practical level of discrimination cannot be obtained, when the photographic light-sensitive material is developed at a high temperature. Since a photographic light-sensitive material needs to meet the requirement of high sensitivity and the requirement of diminishing fog formation, the above-mentioned problem presents a serious impediment to the utilization of the procedure designed for rapid process and diminished adverse effects on the environment.

Meanwhile, specifications including U.S. Pat. Nos. 5,264,337, 5,292,632 and 5,310,635 and W094/22,054 disclose the use of an emulsion having a high content of silver chloride tabular grains made up of a (100) plane to a photographic light-sensitive material as a technique utilizing an emulsion having a high content of silver chloride to a photographic light-sensitive material for the purpose of speeding up and simplifying the developing process. Use of emulsion containing high content of silver chloride enables high-speed developing process.

However, when an image is formed on a light-sensitive material, which is prepared by the technique in the above-mentioned specifications, using the hot development which utilizes the above-mentioned base generating method, the fogging increases. Therefore, there has been the demand for a new technique which suppresses the fogging without decreasing the developing speed and sensitivity while still capable of the rapid and simple image-forming method.

SUMMARY OF THE INVENTION

As is apparent from what is described above, the first object of the present invention is to provide a photographic light-sensitive material which enables simple and rapid image formation while minimizing adverse effects on the environment. Another object of the present invention is to provide an excellent color photographic light-sensitive material with high sensitivity, even in a simple and rapid process, and imparts good discrimination with a minimized fog level.

The above-described objectives of the present invention can be effectively achieved by the following 1) and 2):

1) A silver halide color photographic light-sensitive material which is capable of forming an image by:

after exposing a light-sensitive material, which comprises a first support having thereon at least one photographic light-sensitive layer comprising a light-sensitive silver halide emulsion, a developing agent, a compound capable of forming a dye upon coupling reaction with an oxidation product of the developing agent and a binder;

attaching said light-sensitive material to a processing material, which comprises a second support having thereon a base and/or a base precursor, in such a way that the coated surfaces of the two materials faced each other, in the presence of a small amount of water which corresponds to from 1/10 to 1 time water necessary for giving maximum swelling of all coated layers constituting the light-sensitive material and the processing material; and then heating the light-sensitive material and the processing material, wherein at least one photographic constituent layer contains a compound represented by the formula (A):

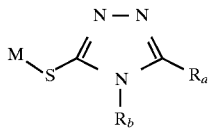

Formula (A)

where $R_a$ represents an alkyl group having 4 or more carbon atoms, an aralkyl group having 7 or more carbon atoms, an aryl group having 6 or more carbon atoms or a heterocyclic group having 4 or more carbon atoms; $R_b$ represents an alkyl group, an aralkyl group, an aryl group or a heterocyclic group; and M represents a hydrogen atom, a silver atom, or an alkali metal atom.

2) A color image forming method comprising imagewise exposing the above-described silver halide color photographic light-sensitive material, supplying water to the photographic light-sensitive material or a processing material comprising a substrate and a constituent layer thereon which comprises a processing layer containing a base or a base precursor, in an amount ranging from 1/10 to the equivalent of an amount which is required for the maximum swelling of the all coated layers of these materials, placing the coating surfaces of the photographic light-sensitive material and the processing material face to face, and heating the materials at a temperature of 60° to 100° C. for a period of 5 to 60 seconds to form a color image.

DETAILED DESCRIPTION OF THE PREFERRED EMBODIMENT

It is necessary for the constituent layer of the photographic light-sensitive material of the present invention to contain at least one type of 3-mercapto-1,2,4-triazoles represented by the foregoing formula (A). Traditionally, a photographic light-sensitive material contains various kinds of mercapto compounds for the purpose of fog prevention or storage stabilization of the material. However, a conventional anti-fogging agent cannot provide a sufficient level of discrimination in the image forming system in which a high-temperature, rapid developing operation is performed by use of a light-sensitive material incorporated with a developing agent. That is, sufficient fog prevention is not attained in high temperature development by means of an anti-fogging agent having slight effect on development inhibition and sensitivity reduction, whereas a compound which exhibits sufficient fog prevention even in a high temperature development often impairs sensitivity.

After serious study, the present inventors have found that a compound represented by the foregoing formula (A) exhibits a specific and excellent effect in the enhancement of the discrimination in the case where the light-sensitive material incorporated with a developing agent is developed at a high temperature in a short period of time.

Details of the compound having the formula (A) are given below.

In formula (A), $R_a$ represents an alkyl group, an aralkyl group, an aryl group or a heterocyclic group. Preferably, $R_a$ is an alkyl group, an aralkyl group or an aryl group.

The number of carbon atoms is 4 or more in the alkyl group, 7 or more in the aralkyl group, 6 or more in the aryl group and 4 or more in the heterocylcic group. In the present invention, a relatively large group is employed as the $R_a$ group (substituent in the 5th position). Although no upper limitis set to the number of carbon atoms, the number is preferably 40 or less, more preferably 30 or less, and most preferably 20 or less in any of the above-mentioned groups.

The alkyl group may be straight, branched or cyclic. Examples of the alkyl group include n-hexyl, n-heptyl, n-octyl, n-nonyl, undecyl, tridecyl, pentadecyl, heptadecyl, neopentyl, 1-ethylpentyl, t-butyl and cyclohexyl groups.

Examples of the aralkyl group include benzyl and phenethyl groups.

Examples of the aryl group include phenyl, naphtyl, biphenylyl and anthryl.

The above-mentioned heterocyclic group may have an aromatic ring, an aliphatic ring or other heterocyclic ring condensed thereto. Preferred examples of a hetero-atom contained in the heterocyclic ring include a nitrogen atom, an oxygen atom and a sulfur atom. Examples of the heterocyclic ring include a pyridine ring, a thiophene ring, an oxazole ring, a thiazole ring, a quinoline ring, a benzoxazole ring and a benzothiazole ring.

The above-mentioned groups may have a substituent, and the number of carbon atoms as mentioned above mean the total number of carbon atoms, including the carbon atoms of the substitutents.

Examples of the substituent include alkyl, alkoxy, aryloxy, alkylthio, arylthio, acyl, alkoxycarbonyl, amino, substituted amino, amido, carbamoyl, N-substituted carbamoyl, ureido, N-substituted ureido, alkylsulfonyl, arylsulfonyl alkylsulfonylamino, arylsulfonyl amino, sulfamoyl, cyano, nitro, trifluoromethyl, halogen atom, hydroxyl, mecapto, carboxyl and sulfo groups. These groups may be substituted further. Carboxyl and sulfo groups may be in the form of a salt. The position of substitutions and the number of the substitutions are not specifically limited.

In the formula (A), $R_b$ represents an alkyl group, an aralkyl group, an aryl group or a heterocyclic group. $R_b$ is preferably an alkyl group, an aralkyl group or an aryl group, and more preferably an aralkyl group or an aryl group.

The number of carbon atoms is 2 or more in the alkyl group, 7 or more in the aralkyl group, 6 or more in the aryl group and 4 or more in the heterocylcic group. Although no upper limit is set to the carbon number, the number is preferably 40 or less, more preferably 30 or less, and most preferably 20 or less in any of the above-mentioned groups.

The alkyl group may be straight, branched or cyclic. Examples of the alkyl group include ethyl, propyl, isopropyl, n-heptyl, isobutyl, t-butyl and cyclohexyl groups.

Examples of the aralkyl group include benzyl and phenethyl groups.

Examples of the aryl group include phenyl, naphtyl, biphenylyl and anthryl groups.

The above-mentioned heterocyclic group may have an aromatic ring, an aliphatic ring or other heterocyclic ring condensed thereto. Preferred examples of a hetero-atom contained in the heterocyclic ring include a nitrogen atom, an oxygen atom and a sulfur atom. Examples of the heterocyclic ring include a pyridine ring, a thiophene ring, an oxazole ring, a thiazole ring, a quinoline ring, a benzoxazole ring and a benzothiazole ring.

Examples of the substituents of $R_b$ are the same as the examples of substitutents set forth for $R_a$.

In the formula (A), M represents a hydrogen atom, a silver atom or an alkali metal atom. A hydrogen atom or a silver atom is particularly preferable.

Normally, a heterocyclic compound exhibits a tautomerism. The 3-mercapto-1,2,4-triazoles represented by the general formula (A) (where M is a hydrogen atom) has the following enolic form and keto form. Although the examples of the 3-mercapto-1,2,4-triazoles are shown herein by way of enolic form, the keto form is naturally included in the scope of the present invention.

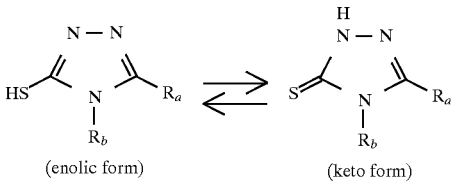

(enolic form) (keto form)

Examples of the compounds represented by the formula (A) are given below.

(A-1)

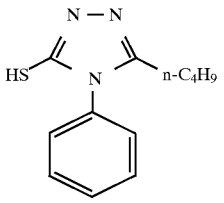

(A-2)

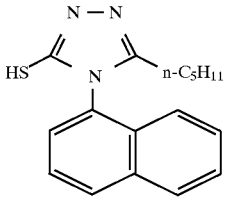

-continued (A-3)

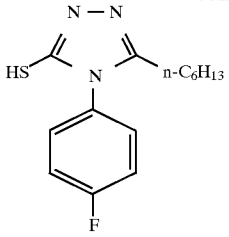

(A-4)

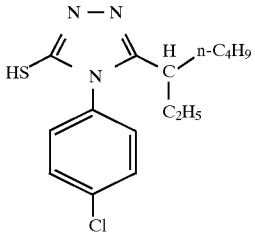

(A-5)

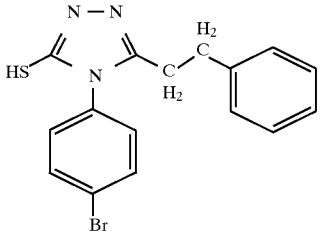

(A-6)

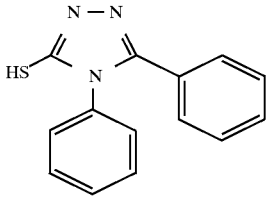

(A-7)

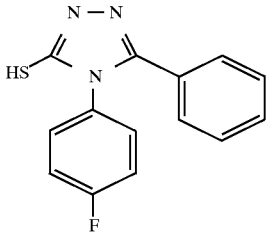

(A-8)

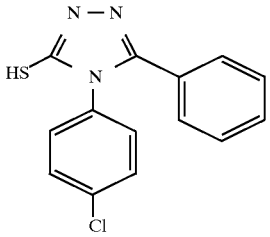

(A-9)

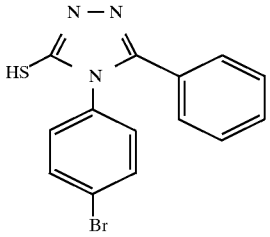

-continued
(A-10)
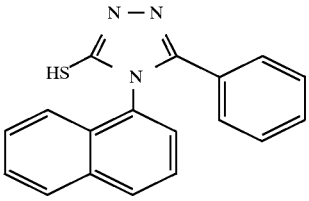
(A-11)
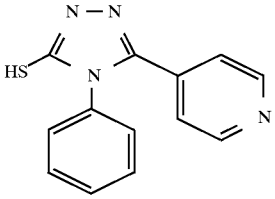
(A-12)
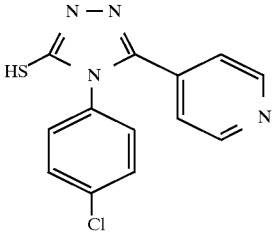
(A-13)
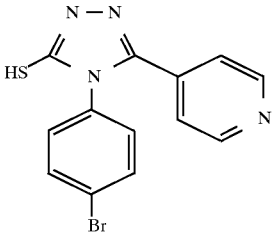
(A-14)
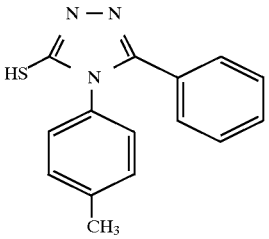
(A-15)
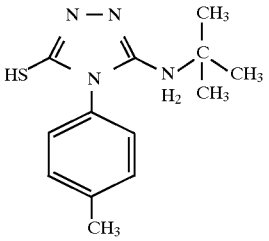
(A-16)
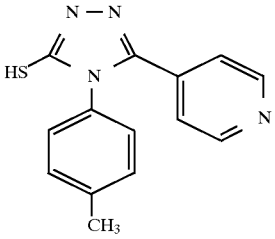
-continued
(A-17)
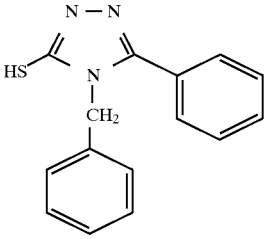
(A-18)
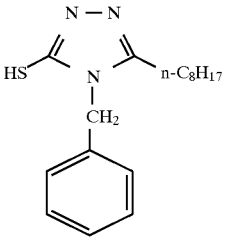
(A-19)
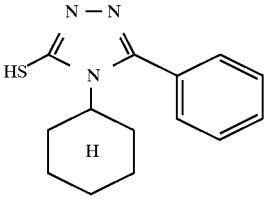
(A-20)
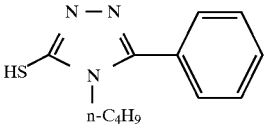
(A-21)
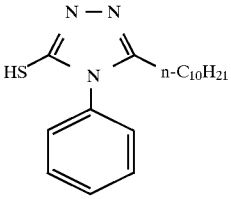
(A-22)
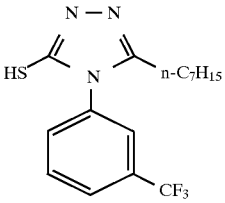
(A-23)
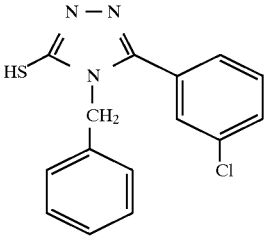
(A-24)
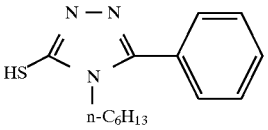

-continued
(A-25)
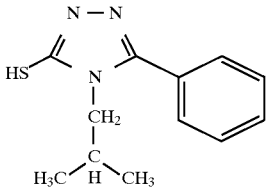
(A-26)
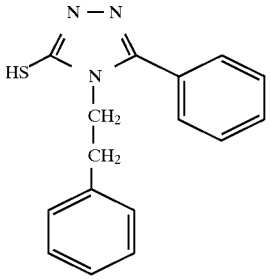
(A-27)
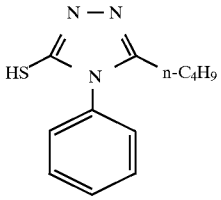
(A-28)
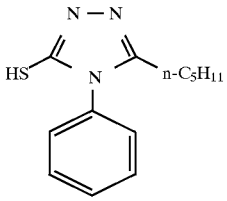
(A-29)
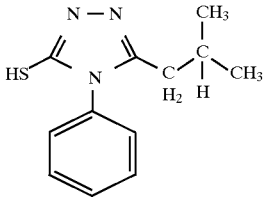
(A-30)
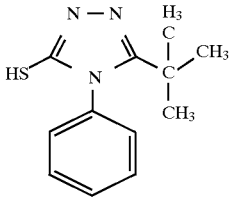
(A-31)
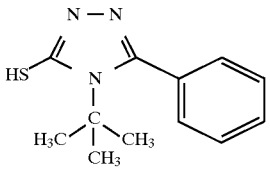
-continued
(A-32)
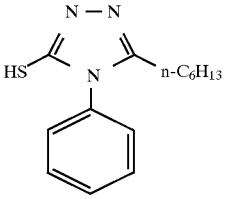
(A-33)
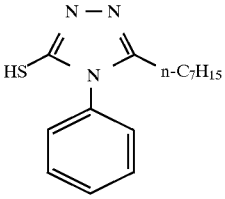
(A-34)
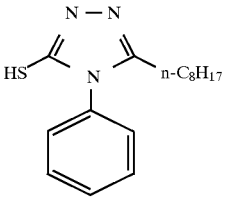
(A-35)
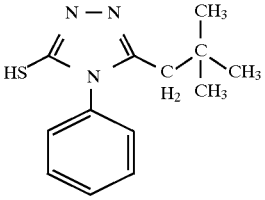
(A-36)
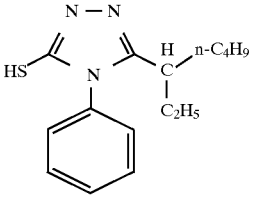
(A-37)
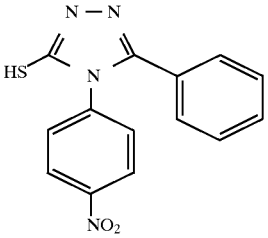
(A-38)
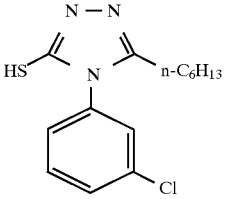

-continued
(A-39)
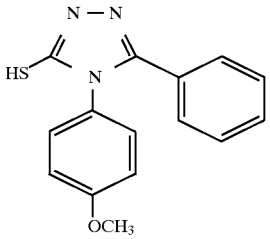
(A-40)
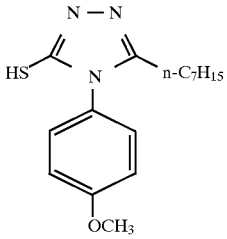
(A-41)
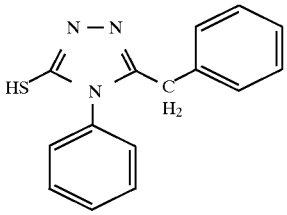
(A-42)
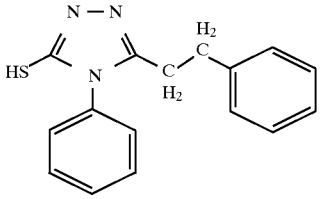
(A-43)
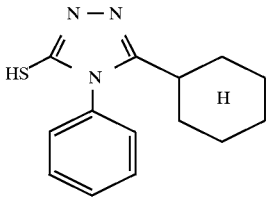
(A-44)
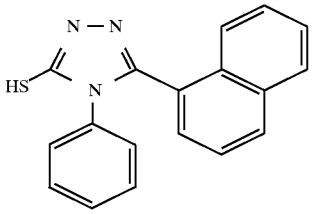
(A-45)
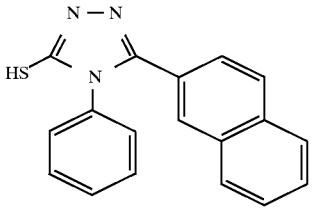
-continued
(A-46)
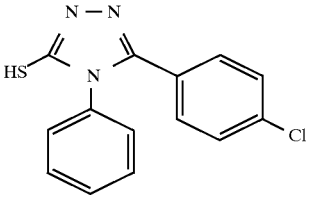
(A-47)
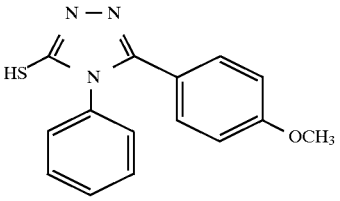
(A-48)
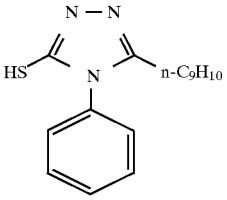
(A-49)
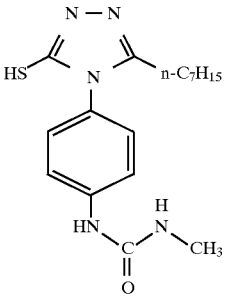
(A-50)
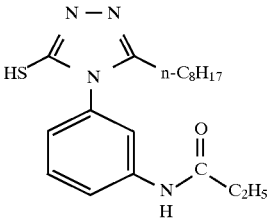
(A-51)
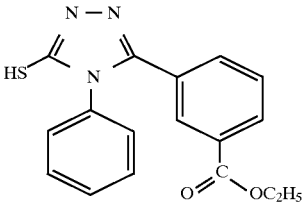
(A-52)
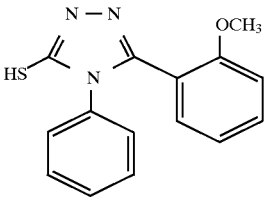

-continued
(A-53)
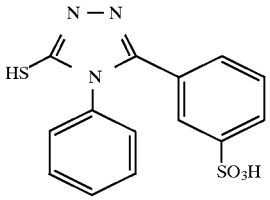
(A-54)
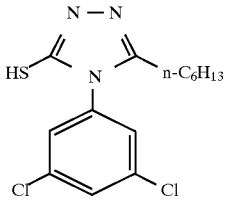
(A-55)
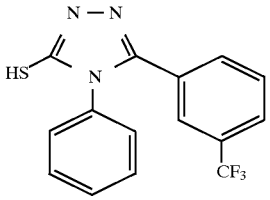
(A-56)
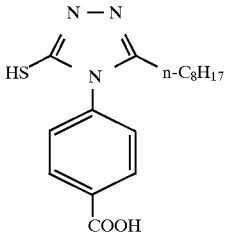
(A-57)
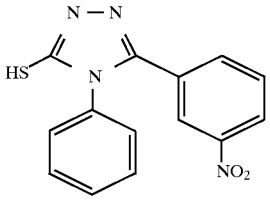
(A-58)
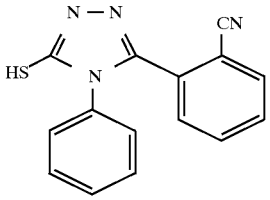
(A-59)
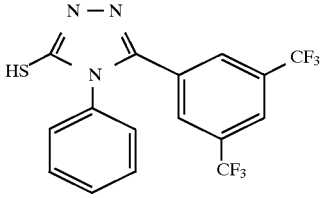
-continued
(A-60)
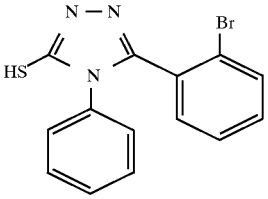
(A-61)
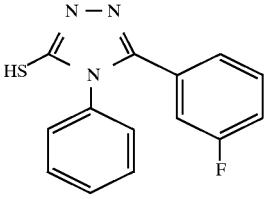
(A-62)
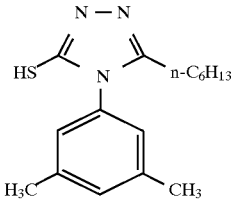
(A-63)
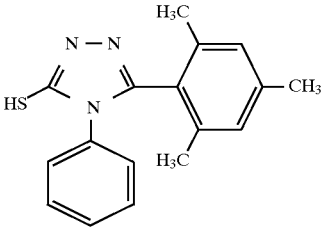
(A-64)
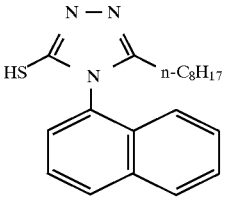
(A-65)
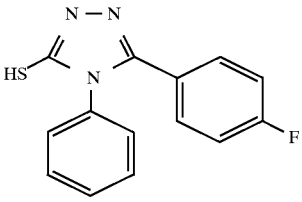
(A-66)
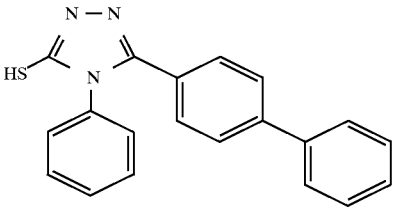

-continued
(A-67)
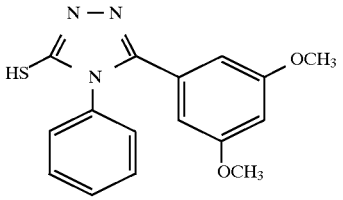
(A-68)
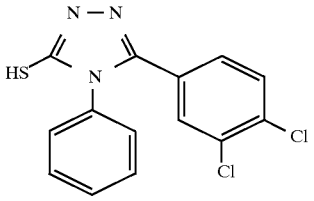
(A-69)
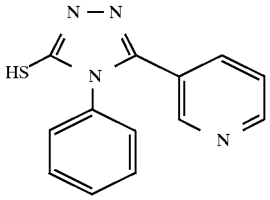
(A-70)
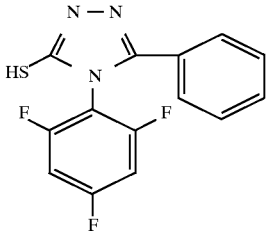
(A-71)
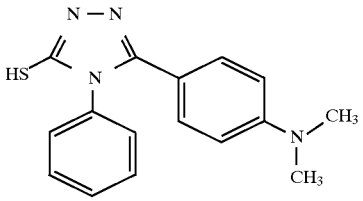
(A-72)
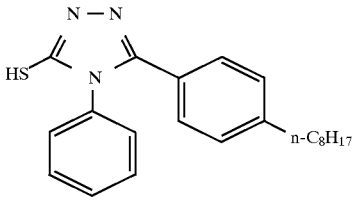
(A-73)
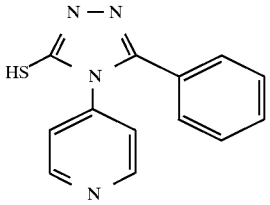
-continued
(A-74)
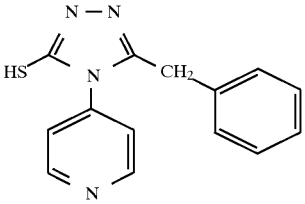
(A-75)
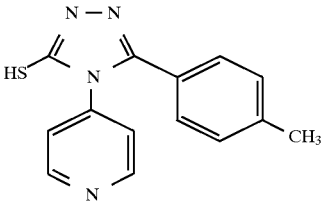
(A-76)
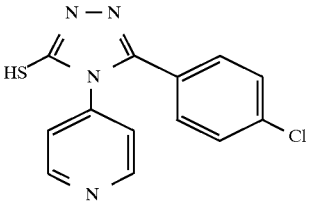
(A-77)
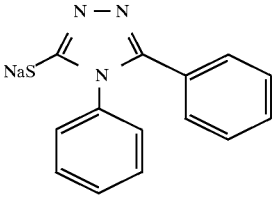
(A-78)
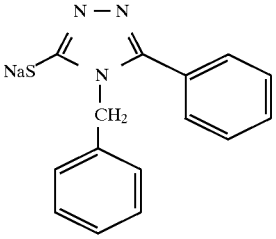
(A-79)
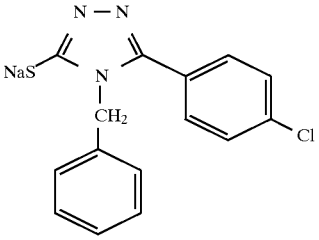
(A-80)
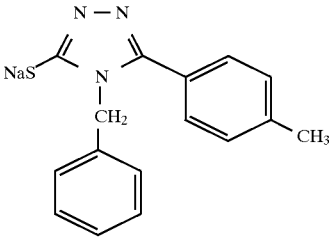

The compounds represented by the formula (A) may be synthesized via the pathways indicated below.

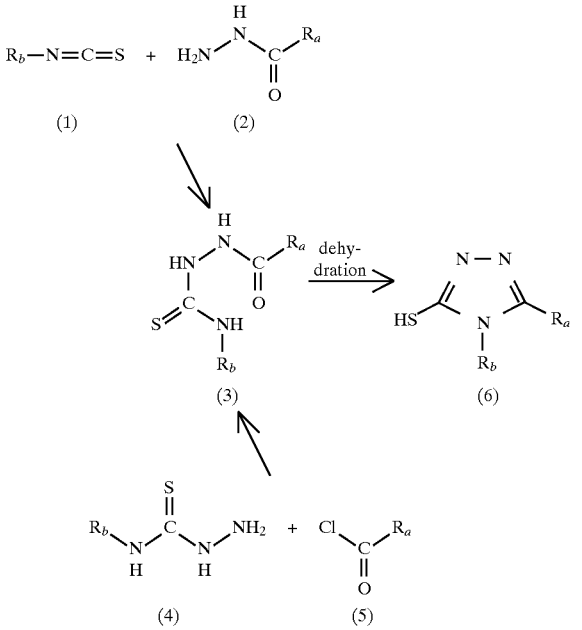

That is, an isocyanate (1) reacts with a hydrazide (2) to form a compound (3). Alternatively, the compound (3) may be synthesized by the reaction between a thiosemicarbazide (4) and a halogenated (e.g., chlorinated) acyl (5) in the presence of a base. A compound (6) represented by the formula (A) can be synthesized by a ring forming dehydration reaction of the compound (3).

In the following examples of synthesis, Example of synthesis 1 employs an isocyanate (1) and a hydrazide (2) as starting substances; and Example of synthesis 2 employs a thiosemicarbazide (4) and a halogenated acyl (5) as starting substances. Other compounds represented by the general formula (A) can be synthesized in a similar way.

Synthesis Example 1

Synthesis of Compound (A-17)

6.8 g (0.05 mol) of benzoylhydrazine was dispersed in 100 ml of acetonitrile. Then, 7.45 g (0.05 mol) of benzyl isothiocyanate was added dropwise to the resultant solution at room temperature. After the addition, the benzoylhydrazine was completely dissolved and, after awhile, white crystals separated. The solution having the crystals was stirred at room temperature for 6 hours and was filtered to obtain the crystals, which were washed with a small amount of acetonitrile and thereafter were dried. The obtained crystals were dissolved in 35 ml of 10% sodium hydroxide aqueous solution and the solution was stirred at 100° C. for one hour. Then, the solution was cooled down to room temperature, thereafter was poured into 0.6 L of ice water, and was neutralized with dilute hydrochloric acid. The white crude product was filtered, washed with water and dried to obtain crude crystals, which were subjected to a recrystallization from ethanol to give 8.8 g of white needle crystals having a melting point in the range of 192° to 194° C. at a yield of 66%.

The mass spectrometric analysis of the compound showed a molecular ion peak at +267.

Value of elementary analysis ($C_{15}H_{13}N_3S$) Calculated: C 67.39% Found: C 67.53% H 4.90% H 5.02% N 15.72% N 15.69 S 11.99% S 11.76%

Synthesis Example 2

Synthesis of Compound (A-34)

8.36 g (0.05 mol) of 4-phenyl-3-thiosemicarbazide was dissolved in 100 ml of tetrahydrofuran. Then, 8.83 g (0.05 mol) of pelargonic acid chloride was added dropwise to the resultant solution while the solution was being ice-cooled. After the addition, the solution was stirred at room temperature for 6 hours. The reaction mixture was poured into 1 L of ice water and was filtered to obtain the separated crystals, which were washed with water and thereafter were dried. The obtained crystals were dissolved in 30 ml of 10% sodium hydroxide aqueous solution and the solution was stirred at 100° C. for one hour. Then, the solution was cooled down to room temperature, thereafter was poured into 0.6 L of ice water, and was neutralized with dilute hydrochloric acid. The white crude product was filtered, washed with water and dried to obtain crude crystals, which were subjected to a recrystallization from an ethanol/water mixture to give 8.9 g of white needle crystals having a melting point in the range of 101° to 103° C. at a yield of 62%.

The mass spectrometric analysis of the compound showed a molecular ion peak at +289.

Value of elementary analysis ($C_{16}H_{23}N_3S$) Calculated: C 66.39% Found: C 66.52% H 8.01% H 7.83% N 14.52% N 14.45 S 11.08% S 11.20%

Although the compound represented by the formula (A) may be added to any layer of the light-sensitive material, it is preferable that the compound be added to a layer containing silver halide. Two or more compounds represented by the formula (A) may be used together.

The amount to be employed of the compound represented by the formula (A) is preferably in the range of $10^{-6}$ to $10^{-1}$ mol, more preferably $10^{-5}$ to $10^{-1}$ mol, and most preferably $10^{-4}$ to $10^{-2}$ mol, based on 1 mol of the silver contained in the light-sensitive material.

In the present invention, a color reproduction according to a color subtraction can be basically used for the preparation of a light-sensitive material to be used for the reproduction of an original scene as a color image. That is, the color information of the original scene can be recorded by means of a color negative film having at least three light-sensitive layers, which have a sensitivity to the blue, green or red wavelength region of light, respectively, and are incorporated, respectively, with a color coupler capable of producing a yellow, magenta or cyan dye as a complementary color of the sensitive wavelength region of the layer. Through the thus obtained color image, color photographic paper, which has a wavelength sensitivity to hue relationship identical to that of the color negative film, is optically exposed to thereby reproduce the original scene. Alternatively, it is also possible to reproduce an image for enjoyment by reading out by means of a scanner the information of the color image obtained by taking a photograph of an original scene.

The light-sensitive material of the present invention can comprise three or more light-sensitive layers, each of which has a sensitivity to light of a wavelength different to the other two.

In addition, the relationship between the sensitive wavelength region and hue of layer may be different from the complementary color relationship described above. In this case, it is possible to reproduce the original color information by image processing, e.g., color conversion, of the image information which has been read out as described above.

Preferably, the light-sensitive material of the present invention has at least two silver halide emulsions having spectral sensitivity in the same wavelength region and have different average grain projected areas. The term "spectral sensitivity in the same wavelength region" as referred to herein means sensitivity to practically the same wavelength region. Therefore, emulsions with slightly different distributions of spectral sensitivity but having light-sensitive regions which mainly overlap with each other, are deemed to be emulsions having photosensitivity in the same wavelength region.

In the present invention, a plurality of emulsions having spectral sensitivity in the same wavelength region and different in the average grain projected area can be used in different light-sensitive layers separately or the plurality of emulsions may be mixed and incorporated into same light-sensitive layer.

When these emulsions are contained in separate light-sensitive layers, the color coupler to be combined therewith preferably has the same hue, however, couplers of forming color in different hues may be mixed to give different colored hues to respective light-sensitive layers or couplers different in the absorption profile of the colored hue may be used in respective light-sensitive layers.

In the present invention, these emulsions having spectral sensitivity in the same wavelength region must be coated to have a construction such that an emulsion having a larger average grain projected area has a ratio of silver halide grain numbers per unit area of the light-sensitive material larger than the ratio of the values obtained by dividing the coated silver amount of the emulsion by the $3/2^{nd}$ power of average grain projected area.

That is, the light-sensitive material for use in the present invention comprises at least two kinds of silver halide emulsion having spectral sensitivity in the same wavelength region and different in the average grain projected area, and said at least two kinds of silver halide emulsions satisfying the following relationship:

$$\frac{C_2}{C_1} > \frac{(D_2/E_2^{3/2})}{(D_1/E_1^{3/2})}$$

wherein $C_1$ and $C_2$ represents numbers of silver halide grains having a smaller average grain projected are and a larger average grain projected area, respectively, per unit area of the light-sensitive material; $D_1$ and $D_2$ represents coated silver halide amounts of silver halide grains having a smaller average grain projected area and a larger average grain projected area, respectively, per unit area of the light-sensitive material; and $E_1$ and $E_2$ represents average grain projected areas of silver halide grains having a smaller average grain projected area and a larger average grain projected area, respectively, per unit area of the light-sensitive material.

More specifically, assuming that (i) emulsion a is an emulsion having the smallest average grain projected area, and emulsions b, c, . . . increase their average grain projected areas in this order; (ii) Ka, Kb, Kc . . . are a number of silver halide grains per unit of emulsions a, b, c, . . . , respectively, and Pa, Pb, Pc, . . . are a ratio of Ka, Kb, Kc, . . . , to Ka, respectively (Pa=1); and (iii) Ha, Hb, Hc, . . . are a ratio of the value obtained by dividing the coated silver amount of emulsions a, b, c, . . . by the $3/2^{nd}$ power of average grain projected area of emulsions a, b, c, . . . , respectively, and Qa, Qb, Qc, . . . are a ratio of Ha, Hb, Hc, . . . , to Ha, respectively (Qa=1), "the larger the average grain projected area of an emulsion is, the larger the ratio of P to Q is" means that the ratio of Pb to Qb (>1) is larger than the ratio of Pa to Qa (=1) and that the ratio of Pc to Qc is larger than the ratio of Pb to Qb. That is, the relationship: . . . >Pc/Qc>Pb/Qb>Pa/Qa is satisfied in the present invention.

In other words, "the larger the average grain projected area of an emulsion, the larger the ratio of P to Q is" means that in emulsion n (n=1 to i; i≧2; the larger n is, the larger the average grain projected area of the emulsion n is), any emulsions k and m (1≦k≦i, 1≦m≦i, k>m) satisfy the relationship: Pk/Qk>Pm/Qm.

In the above-mentioned emulsions, the ratio of the average grain projected area of one emulsion to that of other emulsion is preferably at least 1.25, more preferably at least 1.4, and most preferably 1.6. In the case where three or more emulsions are used, it is preferable that the emulsion, which has the largest average grain projected area, and the emulsion, which has the smallest average grain projected area, meet the above-described relationship.

In the present invention, a plurality of emulsions, the photosensitivity of each of which lies in the same wavelength region and the average grain projected areas of which are different, may be incorporated in different light-sensitive layers or may be incorporated in the same light-sensitive layer. In the case where these emulsions are incorporated in different layers, it is preferable that the layer, which contains the emulsion having a larger average grain projected area, be positioned in an upper layer (closer to the incident light).

In the case where these emulsions are incorporated in different light-sensitive layers, it is preferable that the color couplers to be used in combination with these emulsions produce the same hue. However, a color coupler, which is incorporated in one of the light-sensitive layers, may be different from a color coupler, which is incorporated in other light-sensitive layer so that the light-sensitive layers produce different hues, or otherwise the light-sensitive layers may have couplers leading to different absorption profiles for a hue. In the present invention, it is preferable that the emulsions having spectral sensitivity in the same wavelength region and are used in the same light-sensitive material, be prepared such that a ratio of grain number per unit area of an emulsion having larger average grain projected area to that number of an emulsion having smaller average grain projected area is grater than a ratio of the value obtained by dividing the coated silver amount by the $3/2^{nd}$ power of average grain projected area of an emulsion having larger average grain projected area to that value of an emulsion having smaller average grain projected area. This can be achieved by preparing an emulsion in such a manner that the volume of a grain per projected area gets smaller, as the average of projected areas of grains contained in the emulsion becomes larger.

More concretely, this can be achieved by preparing an emulsion, which comprises tabular silver halide grains having the plane of projection thereof in a shape of a hexagon or rectangle, in such a manner that the quotient of the diameter of a circle, which has an area equivalent to the projected area of a grain, divided by the thickness of the grain, i.e., aspect ratio, becomes greater, as the average of projected areas of grains contained in the emulsion becomes larger.

Furthermore, this can be achieved by preparing an emulsion, which comprises rectangular parallelopiped or cylindrical silver halide grains in such a manner that the ratio of the longer side to the shorter side becomes greater as the average of projected areas of grains contained in the emulsion becomes larger. By the above-described construction, it is possible to obtain an image which has an excellent granulation, even when the light-sensitive material is developed at a high temperature. In addition, it is also possible to achieve high developability and a broad latitude for exposure.

In a color negative conventionally used in photography, in order to attain a desired level of granulation, a silver halide emulsion has been improved and a so-called DIR coupler which releases, by the reaction with the oxidation product of a developing agent, a compound capable of inhibiting the development has been used. The light-sensitive material according to the present invention provides an excellent level of granulation even if DIR coupler is not used in the light-sensitive material. If the light-sensitive material according to the present invention contains DIR coupler, the level of granulation is further improved.

The silver halide in the emulsion of the present invention may be any of silver iodobromide, silver bromide, silver chlorobromide, silver chloroiodide bromide, silver chloroiodide and silver chloride. For example, similar to conventional color negative films, the light-sensitive material of the present invention can contain an emulsion which is composed primarily of silver iodobromide. Although the emulsion, which is composed primarily of silver iodobromide, may contain silver chloride, the content of silver chloride is preferably 8 mol % or less, more preferably 3 mol % or less. An emulsion comprising silver iodobromide grains, which have a layered construction comprising a plurality of layers having different halogen compositions such that at least one layer in the layered construction has a higher iodide content relative to that of a layer adjacent to the inner side of grains thereof and also to that of a layer adjacent to the outer side of grains thereof, is more preferably employed.

As explained above, silver halide grains, which have a diameter larger than the thickness and which have a tabular shape, are preferably employed in the present invention. As for the tabular grains, the quotient of the diameter of a circle, which has an area equivalent to the projected area of a grain, divided by the thickness of the grain, i.e., aspect ratio, is preferably 2 or greater, and more preferably 5 or greater.

In the present invention, it is also possible to use a light-sensitive emulsion of silver halide composed mainly of silver chloride bromide and/or silver chloride grains. Such a light-sensitive emulsion may further contain silver iodide. Where silver iodide is contained, the content of silver iodide is preferably 6 mol % or less, more preferably 2 mol % or less. It is also preferable to use a silver halide emulsion which has a layered grain comprising a plurality of layers having different halogen compositions.

The above-described light-sensitive emulsion is preferably made up of tabular grains which have the main outer surface thereof composed of a (100) plane, which have a plane of projection in the shape of a rectangle having a length to breadth ratio ranging from 1:1 to 1:2 and which have an average aspect ratio of 2 or greater. Various processes including known processes can be employed for the preparation of these emulsions. For example, the processes, which are described in Japanese Patent Application Laid-Open (JP-A) Nos. 5-204,073, 51-88,017, 63-24,238 and 5-264,059, can be used. In the preparation of these emulsions, what is important is a process for forming a nucleus which grows in the shape of a plate. For this purpose, according to the above-mentioned references, it is effective to add an iodide ion or a bromide ion or to add a compound which will be selectively adsorbed onto a specific surface to a solution for the preparation of emulsion at an early stage of formation of grains. The plane of projection of the silver halide grains obtained in the above-mentioned ways is a rectangle, because the main outer face of the grains is composed of a (100) plane. In the present invention, the rectangular plane of projection has a length to breadth ratio preferably ranging from 1:1 to 1:2. That is, from the standpoint of obtaining high sensitivity, tabular grains, which have a plane of projection close to a square, are more desirable than an emulsion composed of rectangular parallelopiped grains close to rods or cubes.

The shape of these silver halide grains can be determined by a carbon replica method which comprises shadowing the silver halide grains and latex grains, which serve as a standard for the grain size determination of the silver halide grains, with such substances as a heavy metal and thereafter observing the grains at the same time under an electron microscope.

The average diameter of silver halide grains (diameter of silver halide grains, as herein referred to, means the diameter of a circle having an area equivalent to the projected area of the grain) is preferably in the range of 0.1 to 10 $\mu$m, more preferably 0.3 to 10 $\mu$m, and most preferably 0.5 to 4 $\mu$m.

The light-sensitive material according to the present invention comprises a substrate and photographic constituent layers formed thereon containing at least one photographic light-sensitive layer comprising a light-sensitive silver halide, a developing agent, a compound which forms a dye by a coupling reaction with an oxide of the developing agent and a binder. The image forming process comprises exposing the light-sensitive material, supplying water to the light-sensitive material or to a processing material which comprises a substrate and a processing layer formed thereon containing a base and/or a base precursor in an amount ranging from 1/10 to the equivalent of an amount which is required for the maximum swelling of the total layers of these materials, putting together the light-sensitive material and the processing material and heating them to form a color image in the light-sensitive material.

The developing agent to be incorporated in the light-sensitive material of the present invention is preferably a compound represented by any of the aforedescribed general formulas I to IV.

It is possible to substantially reduce the haze, if the light-sensitive silver halide emulsion used in the present invention is an emulsion composed of tabular silver halide grains, wherein the grains contain 50 mol % or more of silver chloride and wherein the main outer face of the grain is a (100) plane and the three kinds of edges, which define the exterior shape of the grain and are perpendicular to one another, are in such a relationship that the ratio between the length of the shortest edge and the average of the lengths of the other two edges is less than or equal to 0.5.

In the present invention, a silver halide emulsion, which may be used together with the silver halide emulsion composed of silver halide tabular grains containing 50 mol % or more of silver chloride, whose grains have the main outer face of the grain composed of a (100) plane and have a plane of projection in a shape of a rectangle of a length to breadth ratio preferably ranging from 1:1 to 1:2 and an average aspect ratio of 2 or greater, can be selected from the silver halide emulsions prepared by the methods described, for example, in U.S. Pat. No. 4,500,626, column 50, U.S. Pat. No. 4,628,021, Research Disclosure (hereinafter abbreviated as RD) No. 17,029(1978), RD No. 17,643 (December 1978), pp. 22–23, RD No. 18,716 (November 1979), pp. 648, RDNO. 307,105 (November 1989), pp. 863–865, Japanese Patent Application Laid-open (JP-A) Nos. 62-253,159, 64-13,546, 2-236,546 and 3-110,555, P. Glafkides, Chimie et Physique Photographique, Paul Montel, 1967, G. F. Duffin, Photographic Emulsion Chemistry, Focal Press, 1966, and V. L. Zelikman et al., Making and Coating Photographic Emulsion, Focal Press, 1964.

In the process for preparing the light-sensitive silver halide emulsion of the present invention, it is preferable that a salt removing process be conducted in order to remove excessive salt. For the removal of salt, employable methods include a Noodle water-washing method in which a salt is removed by the gelation of gelatin and a floculation method which utilizes such material as an inorganic salt comprising a polyvalent anion (e.g., sodium sulfate), an anionic surfactant, an anionic polymer (e.g., polystyrene sulfonic acid sodium salt) or a gelatin derivative (e.g., aliphatic-acylated gelatin, aromatic-acylated gelatin and aromatic-carbamoylated gelatin). A floculation method is preferably used.

For a variety of purposes, the light-sensitive silver halide emulsion in the present invention may contain a heavy metal such as iridium, rhodium, platinum, cadmium, zinc, thallium, lead, iron and osmium. These heavy metals may be used alone or in a combination of two or more of them. Although the amount added of such compounds is selected depending on the purpose of use, this amount is generally in the range of $10^{-9}$ to $10^{-3}$ mol based on 1 mol of silver halide. The heavy metal may be present uniformly in a silver halide grain or may be present in a localized manner within or on the surface of a silver halide grain. Preferred examples of these emulsions are the emulsions described in Japanese Patent Application Laid-Open (JP-A) Nos. 2-236,542, 1-116,637 and 5-181,246.

Such compound as a rhodanate, ammonia, a tetra-substituted thiourea compound, an organic thioether derivative described in Japanese Patent Application Publication (JP-B) No.47-11,386 and a sulfur-containing compound described in Japanese Patent Application Laid-Open (JP-A) No. 53-144,319 may be used as a solvent for silver halide in the grain forming stage for the light-sensitive silver halide emulsion used in the present invention.

For other conditions for the silver halide grain formation, reference will be made, for example, to P. Glafkides, Chimie et Physique Photographique, Paul Montel, 1967, G. F. Duffin, Photographic Emulsion Chemistry, Focal Press, 1966, V. L. Zelikman et al., Making and Coating Photographic Emulsion, Focal Press, 1964, and the like. That is, an employable method may be selected from an acidic method, a neutral method and an ammonia method. Further, any method selected from a single jet method, a double jet method and a combination thereof may be used as a method for reacting a soluble silver salt with a soluble halides. A double jet method is preferable for obtaining a monodisperse emulsion.

An reversed mixing method in which grains are formed in the presence of an excess of silver ion can also be employed. A so-called controlled double jet method in which pAg of the liquid phase for the formation of silver halide is kept constant can also be employed as a double jet method.

Meanwhile, the concentrations, amounts to be added and adding rates of the silver salt and halogen salt may be increased in order to accelerate the growth of the grains (Japanese Patent Application Laid-Open (JP-A) Nos. 55-142,329 and 55-158,124 and U.S. Pat. No. 3,650,757).

The stirring of the reaction mixture may be effected by any known method. Further, the temperature and pH of the reaction mixture during the formation of silver halide grains may be selected depending on the purpose. The pH is preferably in the range of 2.2 to 7.0, and more preferably 2.5 to 6.0.

A light-sensitive silver halide emulsion is normally a chemically sensitized silver halide emulsion. A sensitizing method by means of chalcogen, such as sulfur sensitization, selenium sensitization or tellurium sensitization, a sensitizing method by means of a rare metal, such as gold, platinum or palladium, and a sensitizing method by means of reduction, which are known sensitizing methods in the preparation of conventional light-sensitive emulsions, may be used alone or in combination thereof as a chemical sensitizing method of the light-sensitive silver halide emulsion used in the present invention (see, for example, Japanese Patent Application Laid-Open (JP-A) Nos. 3-110,555 and 5-241,267). A chemical sensitization according to any of the above-mentioned methods can be effected in the presence of a nitrogen-containing heterocyclic compound (Japanese Patent Application Laid-Open (JP-A) No. 62-253,159). Besides, an anti-fogging agent, which is described later, maybe added to a silver halide emulsion after the chemical sensitization thereof. More concretely, the methods, which are described in Japanese Patent Application Laid-Open (JP-A) Nos. 5-45,833 and 62-40,446, can be used.

When a chemical sensitization is carried out, pH is preferably in the range of 5.3 to 10.5, and more preferably 5.5 to 8.5, while pAg is preferably in the range of 6.0 to 10.5, and more preferably 6.8 to 9.0.

The coated weight of the light-sensitive silver halide to be used in the present invention is in the range of 1 mg to 10 $g/m^2$, preferably 10 mg to 8 $g/m^2$, and most preferably 100 mg to 6 $g/m^2$, based on the weight of silver.

In order to impart color-sensitivity, such as green-sensitivity or red-sensitivity, to the light-sensitive silver halide, the light-sensitive silver halide emulsion is spectrally sensitized by means of a methine dye or the like. Further, if necessary, a blue-sensitive emulsion may be spectrally sensitized in order to enhance sensitivity to the light of the blue color region.

Examples of employable dyes include cyanine dyes, merocyanine dyes, complex cyanine dyes, complex merocyanine dyes, holopolar cyanine dyes, hemicyanine dyes, styryl dyes and hemioxonol dyes.

More concrete examples of these sensitizing dyes are disclosed, for example, in U.S. Pat. No. 4,617,257 and Japanese Patent Application Laid-Open (JP-A) Nos. 59-180,550, 64-13,546, 5-45,828 and 5-45,834.

Although these sensitizing dyes may be used alone, they may also be used in a combination thereof. A combination of these sensitizing dyes is often used particularly for supersensitization or for wavelength adjustment of spectral sensitization.

The light-sensitive silver halide emulsion used in the present invention may contain a compound which is a dye having no spectral sensitization effect itself or a compound substantially incapable of absorbing a visible light but which exhibits a supersensitizing effect (e.g., compounds described in U.S. Pat. No. 3,615,641 and Japanese Patent Application Laid-Open (JP-A) No. 63-23,145).

The above-mentioned sensitizing dye can be added to the emulsion at the stage of chemical aging or thereabout, or before or after the formation of the nucleus of the silver halide grains in accordance with the descriptions in U.S. Pat. Nos. 4,183,756 and 4,225,666. These sensitizing dyes or supersensitizers may be added to the emulsion as a solution in an organic solvent, such as methanol, a dispersion in gelatin or solution containing a surfactant. The amount to be added is generally in the range of $10^{-8}$ to $10^{-2}$ mol based on 1 mol of silver halide.

Known photographic additives, which are used in the above-described processes and in the present invention, are described in the aforementioned RD No. 17,643, RD No. 18,716 and RD No. 307,105, the relationship in the description is shown below.

| Kinds of additives: | RD17,643 | RD18,716 | RD307,105 |
|---|---|---|---|
| 1. Chemical sensitizer | pp. 23 | pp. 648, RC | pp. 866 |
| 2. Sensitivity enhancer | | pp. 648, RC | |
| 3. Spectral sensitizer/ Supersensitizer | pp. 23–24 | pp. 648, RC~ pp. 649, RC | pp. 866–868 |
| 4. Brightening agent | pp. 24 | pp. 648, RC | pp. 868 |
| 5. Anti-fogging agent/ Stabilizer | pp. 24–25 | pp. 649, RC | pp. 868–870 |
| 6. Light absorber/ Filter/Dye/ Ultraviolet ray absorber | pp. 25–26 | pp. 649, RC~ pp. 650, LC | pp. 873 |
| 7. Dye image stabilizer | pp. 25 | pp. 650, LC | pp. 872 |
| 8. Film hardener | pp. 26 | pp. 651, LC | pp. 874–875 |
| 9. Binder | pp. 26 | pp. 651, LC | pp. 873–874 |
| 10. Plasticizer/ Lubricant | pp. 27 | pp. 650, RC | pp. 876 |
| 11. Coating aid/ Surfactant | pp. 26–27 | pp. 650, RC | pp. 875–876 |
| 12. Anti-static agent | pp. 27 | pp. 650, RC | pp. 876–877 |
| 13. Matting agent | | | pp. 878–879 |

(RC: right column, LC: left column)

An organic metal salt may be used as an oxidant together with a light-sensitive silver halide in the present invention. Among these organic metal salts, an organic silver salt is particularly preferable.

Examples of the organic compounds which can be used for the preparation of the above-mentioned organic silver salts serving as an oxidant include benzotriazoles, fatty acids and other compounds described in U.S. Pat. No. 4,500,626, columns 52–53. The silver acetylide, which is described in U.S. Pat. No. 4,775,613, is also useful. These silver salts may be used alone or in a combination of two or more of them.

The above-mentioned organic silver salt can be used in an amount in the range of 0.01 to 10 mol, and preferably 0.01 to 1 mol, based on 1 mol of the light-sensitive silver halide. The total coated weight of the light-sensitive silver halide and the organic silver salt is in the range of 0.05 to 10 g/m$^2$, and preferably 0.1 to 4 g/m$^2$, based on the weight of silver.

The binder for a constituent layer of the light-sensitive material is preferably a hydrophilic material, examples of which include those described in the aforesaid Research Disclosure and in Japanese Patent Application Laid-Open (JP-A) No. 64-13,546, pp. 71–75. More specifically, the binder is preferably a transparent or translucent hydrophilic material, exemplified by a naturally occurring compound, such as a protein including gelatin and a gelatin derivative; and a polysaccharide including a cellulose derivative, starch, gum arabic, dextran and pullulane, and by a synthetic polymer such as polyvinyl alcohol, polyvinyl pyrrolidone and acryl amide polymer. Also usable as the binder is a highly water-absorbent polymer described in U.S. Pat. No. 4,960,681 and Japanese Patent Application Laid-Open (JP-A) No. 62-24,526, for example, a homopolymer composed of a vinyl monomer having —COOM or —$SO_3M$ (M stands for a hydrogen atom or an alkali metal), or a copolymer obtained by a combination of these monomers or obtained by a combination of at least one of these monomers and another monomer(s) such as sodium methacrylate and ammonium methacrylate (e.g., SUMIKAGEL L-5H manufactured by Sumitomo Chemical Co., Ltd.). These binders may be used alone or in a combination of two or more of them. Particularly, a combination of gelatin and any of the above-mentioned non-gelatin binders is preferable. Depending on purposes, a lime-treated gelatin, acid-treated gelatin and delimed gelatin which has undergone a deliming process to decrease the content of calcium and the like can be used. Alternatively, a combination of these treated gelatin substances may be employed.

In the present invention, the coated weight of the binder is preferably 20 g/m$^2$ or less, and more preferably 10 g/m$^2$ or less.

The coupler to be used in the present invention may be a 4-equivalent coupler or a 2-equivalent coupler. In these couplers, the nondiffusive group may form a polymeric chain. Details of the coupler are described, for example, in T. H. James, The Theory of the Photographic Process, 4th edition, pp. 291–334, pp. 354–361, and in Japanese Patent Application Laid-Open (JP-A) Nos. 58-123,533, 58-149,046, 58-149,047, 59-111,148, 59-124,399, 59-174,835, 59-231,539, 59-231,540, 60-2,950, 60-2,951, 60-14,242, 60-23,474 and 60-66,249, and Japanese Patent Application Laid-Open (JP-A) Nos. 8-110,608, 8-146,552 and 8-146,578.

Further, the following couplers are preferably used in the present invention.

Yellow couplers: couplers represented by the formulas (I) and (II) in EP 502,242A; couplers represented by the formulas (1) and (2) in EP 513,496A; couplers represented by the general formula (I) described in claim 1 of Japanese Patent Application Laid-Open (JP-A) No. 5-307,248; couplers represented by the general formula (D) in U.S. Pat. No. 5,066,576, column 1, lines 45 to 55; couplers represented by the general formula (D) in Japanese Patent Application Laid-Open (JP-A) No. 4-274,425, paragraph 008; couplers described in EP 498,38A1, claim 1 on page 40; couplers represented by the formula (Y) in EP 447,969A1, pp. 4; and couplers represented by the general formulas (I) to (IV) in U.S. Pat. No. 4,476,219, column 7, lines 36 to 58.

Magenta couplers: couplers described in Japanese Patent Application Laid-Open (JP-A) Nos. 3-39,737, 6-43,611, 5-204,106 and 4-3,626.

Cyan couplers: couplers described in Japanese Patent Application Laid-Open (JP-A) Nos. 4-204,843 and 4-43,345.

Polymeric couplers: couplers described in Japanese Patent Application Laid-Open (JP-A) No. 2-44,345.

The couplers described in U.S. Pat. No. 4,366,237, GB 2,125,570, EP 96,570 and DE 3,234,533 are preferable as a coupler which generates a dye having an appropriate diffusive property.

The light-sensitive material in the present invention may contain a functional coupler, for example, a coupler which is designed to correct the unnecessary absorption of a coloring dye, such as the yellow colored cyan coupler and the yellow colored magenta coupler described in EP 456,257A1, the magenta colored cyan coupler described in U.S. Pat. No. 4,833,069 and the masking coupler represented by the formula (2) in U.S. Pat. No. 4,837,136 and by the formula (A) in claim 1 of WO 92/11,575 (compounds shown at pages 36–45 in particular).

In the present invention, it is preferable to use a coupler or other compound which reacts with the oxidation product of a developing agent to release a photographically important compound.

Examples of the compounds (including couplers) which react with the oxidation product of a developing agent to release photographically important compound residues, include a compound which releases a development inhibitor such as compounds represented by the formulas (I) to (IV) described on page 11 in EP 378, 236A1, compounds represented by the formula (I) described on page 7 in EP 436, 938A2, compounds represented by the formula (1) described in Japanese Patent Application Laid-Open (JP-A) No.5-307, 248, compounds represented by the formulas (I) to (III) described on pages 5 and 6 in EP 440,195A2, compound-ligand releasing compounds represented by the formula (I) described in claim 1 of Japanese Patent Application Laid-Open (JP-A) No. 6-59,411 and compounds represented by LIG-X described in claim 1 of U.S. Pat. No. 4,555,478.

In the present invention, the amount of the coupler added is preferably from 1/1000 to 1 mol, and more preferably from 1/500 to 1/5 mol based on 1 mol of silver halide.

The light-sensitive material of the present invention should contain a developing agent, the oxide of which results from the silver development and is capable of coupling with the aforementioned coupler to form a dye.

Examples of such a combination of a coupler and a developing agent include a combination of p-phenylene diamines as a developing agent and a phenol or active methylene coupler described in U.S. Pat. No. 3,531,256 and a combination of p-aminophenols as a developing agent and an active methylene coupler described in U.S. Pat. No. 3,761,270.

Further, a sulfonamide phenol described in U.S. Pat. No. 4,021,240 and Japanese Patent Application Laid-Open (JP-A) No. 60-128,438, is preferable, because this combination assures an excellent storage stability of the raw light-sensitive material.

In the present invention, a precursor of a developing agent may be used, examples of which include an indoaniline compound described in U.S. Pat. No. 3,342,597, a Schiff base-type compound described in U.S. Pat. No. 3,342,599 and in Research Disclosure Nos. 14,850 and 15,159, an aldol compound described in Research Disclosure No. 13,924, a metal salt complex described in U.S. Pat. No. 3,719,492 and a urethane compound described in Japanese Patent Application Laid-Open (JP-A) No. 53-135,628.

Other combinations, i.e., a combination of a sulfonamide phenol developing agent and a coupler as described in Japanese Patent Application Laid-Open (JP-A) No. 9-15,806 and a combination of a hydrazine developing agent and a coupler as described in Japanese Patent Application Laid-Open (JP-A) Nos. 8-286,340 and 8-234,388, are also preferable for use in the light-sensitive material of the present invention.

In the present invention, it is preferable to use a compound, which is represented by one of the formulas (I), (II), (III) or (IV), as a developing agent.

Details of these developing agents are described below.

The compounds represented by the formula (I) are generally called a sulfonamide phenol and are known compounds in the art. In these compounds, preferably at least one substituent selected from the substituents $R_1$ to $R_5$ has a ballast group having 8 or more carbon atoms.

In the formula (I), $R_1$ to $R_4$ each represent a hydrogen atom, a halogen atom (such as chlorine atom and bromine atom), an alkyl group (such as methyl, ethyl, isopropyl, n-butyl and t-butyl groups), an aryl group (such as phenyl, tolyl and xylyl groups), an alkylcarbonamide group (such as acetylamino, propionylamino and butyloylamino groups), an arylcarbonamide group (such as benzoylamino), an alkylsulfonamide group (such as methanesulfonylamino and ethanesulfonylamino groups), an arylsulfonamide group (such as benzenesulfonylamino and toluenesulfonylamino groups), an alkoxy group (such as methoxy, ethoxy and butoxy groups), an aryloxy group (such as phenoxy group), an alkylthio group (such as methylthio, ethylthio and butylthio groups), an arylthio group (such as phenylthio and tolylthio groups), an alkylcarbamoly group (such as methylcarbamoyl, dimethylcarbamoyl, ethylcarbamoyl, diethylcarbamoyl, dibutylcarbamoyl, piperidylcarbamoyl and morpholylcarbamoyl), an arylcarbamoyl group (such as phenylcarbamoyl, methylphenylcarbamoyl, ethylphenylcarbamoyl and benzylphenylcarbamoyl groups), a carbamoyl group, an alkylsulfamoyl group (such as methysulfamoyl, dimethylsulfamoyl, ethylsulfamoyl, diethylsulfamoyl, dibutylsulfamoyl, piperidylsulfamoyl and morpholylsulfamoyl), an arylsulfamoyl group (such as phenylsulfamoyl, methylphenylsulfamoyl, ethylphenylsulfamoyl and benzylphenylsulfamoyl groups), a sulfamoyl group, a cyano group, an alkylsulfonyl group (such as methanesulfonyl and ethanesulfonyl groups), an arylsulfonyl group (such as phenylsulfonyl, 4-chlorophenylsulfonyl and p-toluenesulfonyl groups), an alkoxycarbonyl group (such as methoxycarbonyl, ethoxycarbonyl and butoxycarbonyl groups), an aryloxycarbonyl group (such as phenoxycarbonyl group), an alkylcarbonyl group (such as acetyl, propionyl and butyloyl groups), an arylcarbonyl group (such as benzoyl and alkylbenzoyl groups) or an acyloxy group (such as acetyloxy, propionyloxy and butyloyloxy groups). Among the $R_1$ to $R_4$ groups, $R_2$ and $R_4$ are each preferably a hydrogen atom. Further, the total of Hammett's constants $\sigma_p$ of $R_1$ to $R_4$ is preferably 0 or greater. $R_5$ represents an alkyl group (such as methyl, ethyl, butyl, octyl, lauryl, cetyl and stearyl groups), an aryl group (such as phenyl, tolyl, xylyl, 4-methoxyphenyl, dodecylphenyl, chlorophenyl, trichlorophenyl, nitrochlorophenyl, triisopropylphenyl, 4-dodecyloxyphenyl and 3,5-di-(methoxycarbonyl) groups) or a heterocyclic group (such as pyridyl group).

The compounds represented by the formula (II) are generally called a carbamoylhydrazine and are known compounds in the art. In these compounds, $R_5$ or a substituent linked to a ring preferably has a ballast group having 8 or more carbon atoms.

In the formula (II), Z represents a group of atoms forming an aromatic ring. The aromatic group indicated by Z should be sufficiently electron-attractive in order to make the compound silver development activity. From this standpoint, preferably employed is a heterocyclic ring, a nitrogen-containing aromatic ring in particular, or an aromatic ring such as a benzene ring having an electron-attractive substituent. In this sense, preferred aromatic rings include a pyridine ring, a pyradine ring, a pyrimidine ring, a quinoline ring and a quinoxaline ring. In the case of a benzene ring, examples of the substituents include a halogen atom (such as chlorine atom and bromine atom), an alkylcarbamoly group (such as methylcarbamoyl, dimethylcarbamoyl, ethylcarbamoyl, diethylcarbamoyl, dibutylcarbamoyl, piperidylcarbamoyl and morpholynocarbamoyl), an arylcarbamoyl group (such as phenylcarbamoyl, methylphenylcarbamoyl, ethylphenylcarbamoyl and benzylphenylcarbamoyl groups), a carbamoyl group, an alkylsulfamoyl group (such as methysulfamoyl, dimethylsulfamoyl, ethylsulfamoyl, diethylsulfamoyl, dibutylsulfamoyl, piperidylsulfamoyl and morpholinylsulfamoyl),an arylsulfamoyl group (such as phenylsulfamoyl, methylphenylsulfamoyl, ethylphenylsulfamoyl and benzylphenylsulfamoyl groups), a sulfamoyl group, a cyano group, an alkylsulfonly group (such as methanesulfonyl and ethanesulfonyl groups), an arylsulfonyl group (such as phenylsulfonyl, 4-chlorophenylsulfonyl and p-toluenesulfonyl groups), an alkoxycarbonyl group (such as methoxycarbonyl, ethoxycarbonyl and butoxycarbonyl groups), an aryloxycarbonyl group (such as phenoxycarbonyl group), an alkylcarbonyl group (such as acetyl, propionyl and butyloyl groups) and an arylcarbonyl group (such as benzoyl and alkylbenzoyl groups). The total of Hammett's constant σ of the above substituents is preferably 1 or greater.

The compounds represented by the formula (III) are generally called carbamoylhydrazines. The compounds represented by the formula (IV) are generally called sulfonylhydrazines. Both of these compounds are known compounds in the art. In these compounds, preferably at least one substituent selected from the substituents $R_7$ to $R_8$ has a ballast group having 8 or more carbon atoms.

In the formulas (III) and (IV), $R_6$ represents an alkyl group (such as methyl or ethyl group). X represents an oxygen atom, a sulfur atom, a selenium atom or an alkyl- or aryl-substituted tertiary nitrogen atom. Preferably, X represents an alkyl-substituted tertiary nitrogen atom. $R_7$ and $R_8$ each represent a hydrogen atom or a substituent (examples of which include the above examples of substituents on benzene ring for Z). $R_7$ and $R_8$ may join each other to form a double bond or a ring.

Among the compounds represented by the formulas (I) to (IV), the compounds represented by the formulas I and (II) are preferable from the viewpoint of superior storage stability of the raw light-sensitive material.

In the above compounds, the substituents $R_1$ to $R_8$ may each have a substituent, examples of which include the above examples of substituents on the benzene ring Z.

Concrete examples of the compounds represented by the formulas (I) to (IV) are given below, but a developing agent used in the present invention are not limited to these examples.

D-1

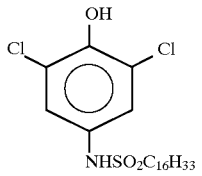

D-2

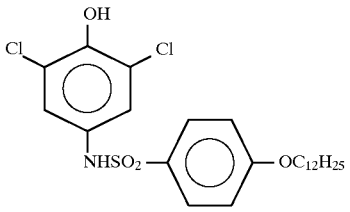

D-3

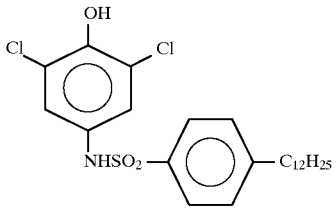

D-4

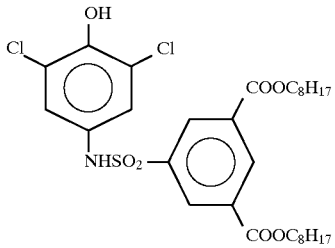

D-5

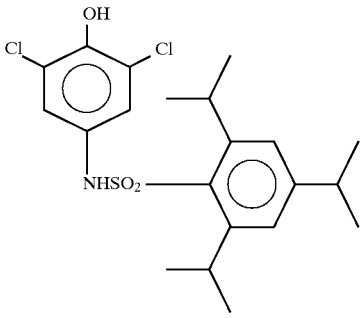

D-6

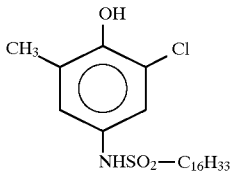

D-7

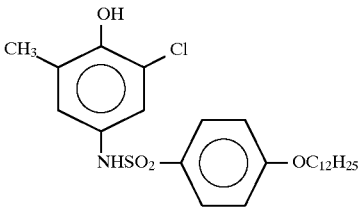

D-8

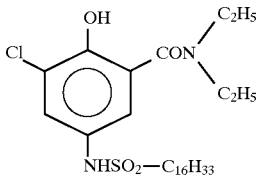

-continued
D-9
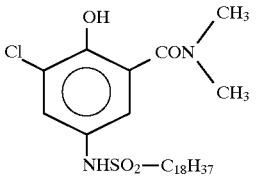
D-10
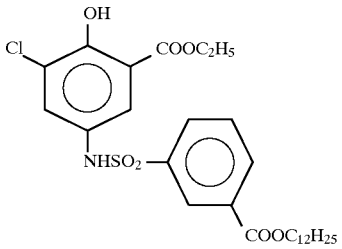
D-11
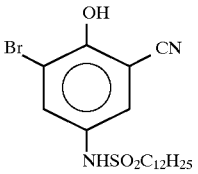
D-12
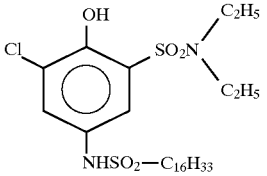
D-13
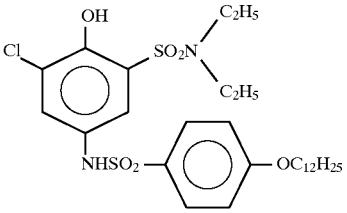
D-14
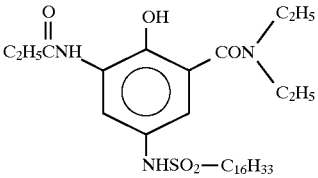
D-15
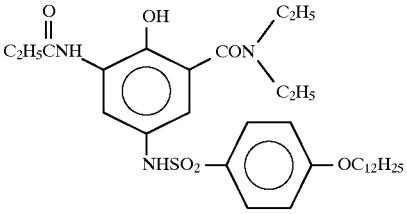
D-16
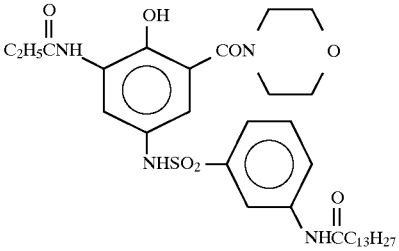
D-17
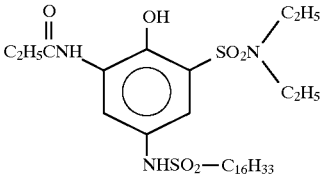
D-18
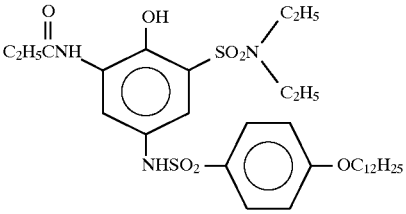
D-19
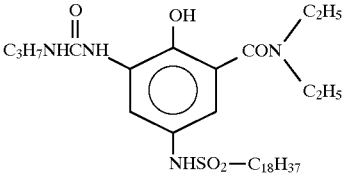
D-20
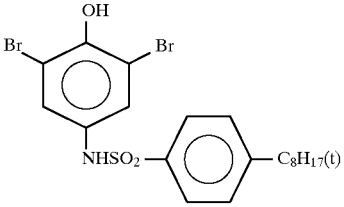
D-21
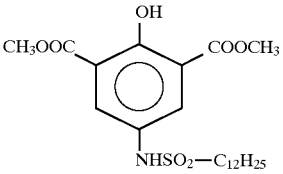
D-22
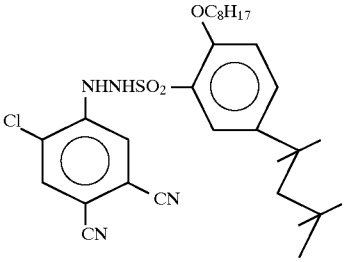

-continued
D-23
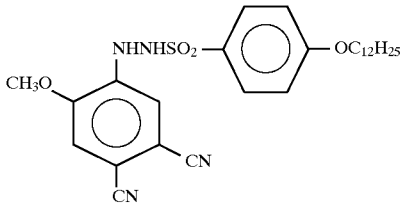
D-24
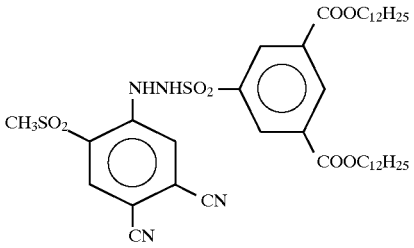
D-25
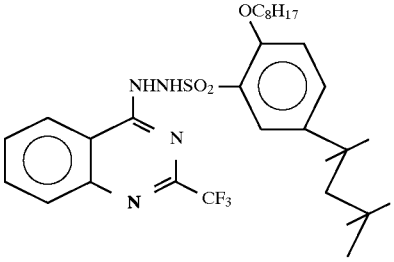
D-26
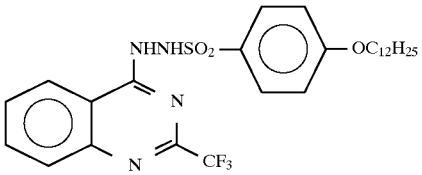
D-27
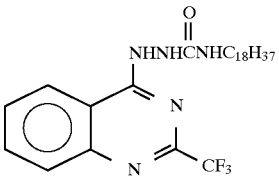
D-28
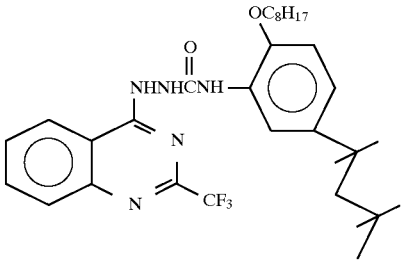
D-29
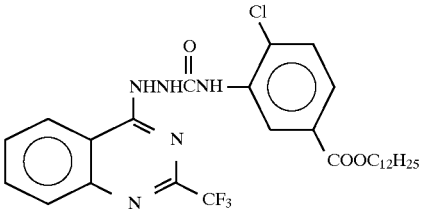
D-30
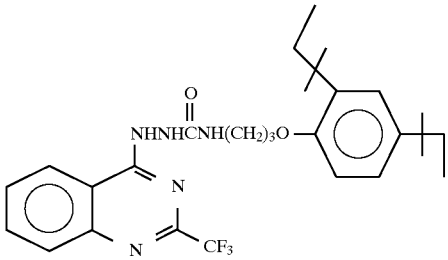
D-31
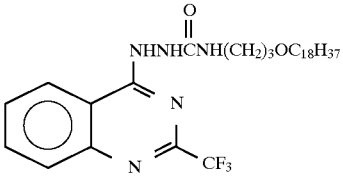
D-32
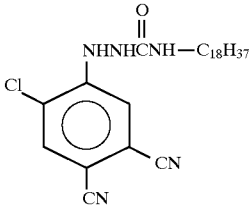
D-33
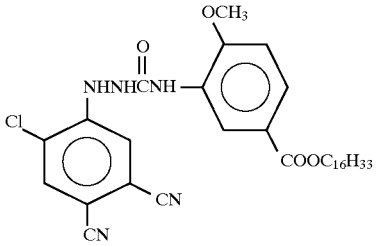
D-34
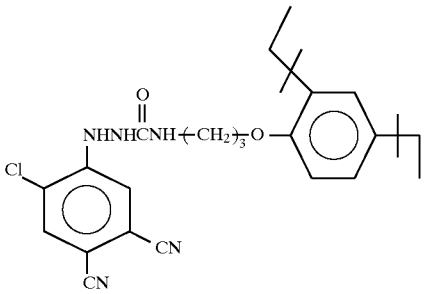

-continued
D-35
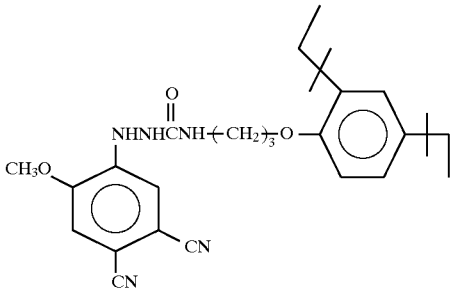
D-36
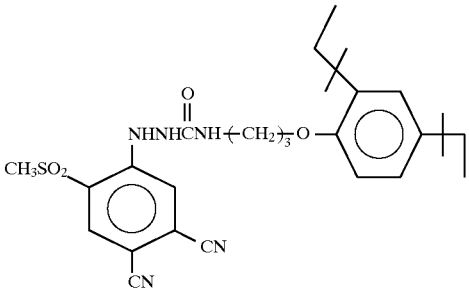
D-37
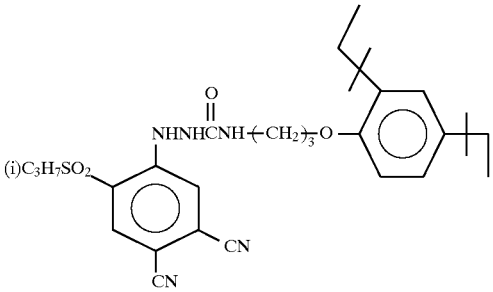
D-38
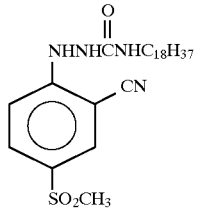
D-39
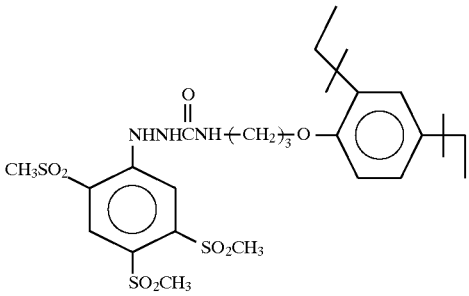
D-40
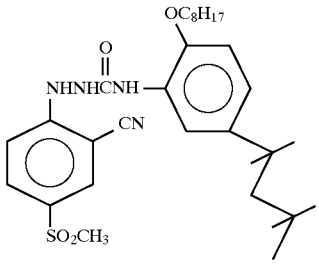
D-41
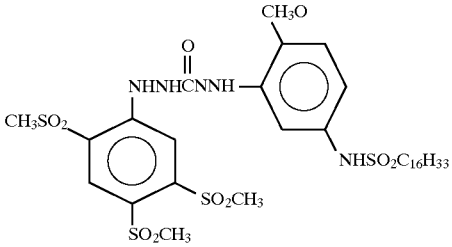
D-42
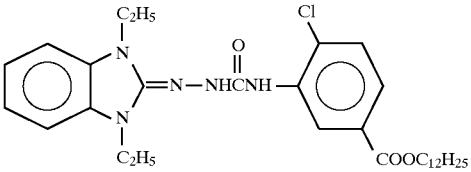
D-43
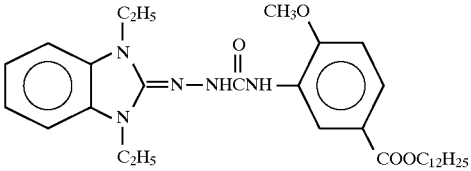
D-44
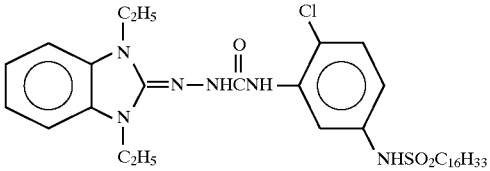
D-45
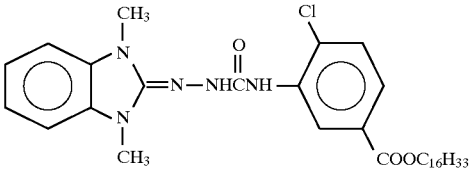
D-46
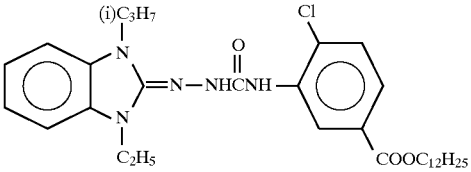

-continued
D-47
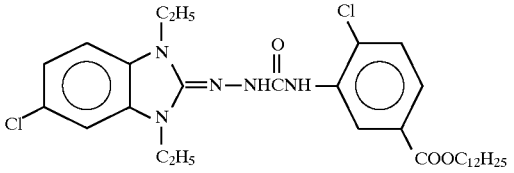
D-48
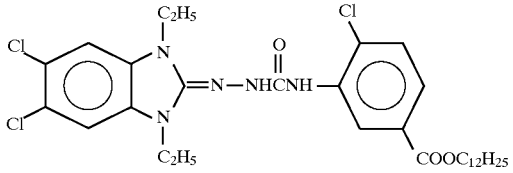
D-49
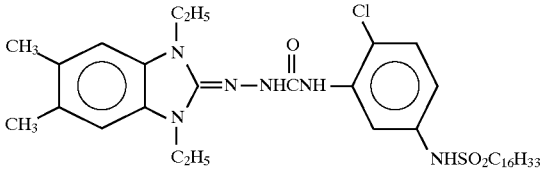
D-50
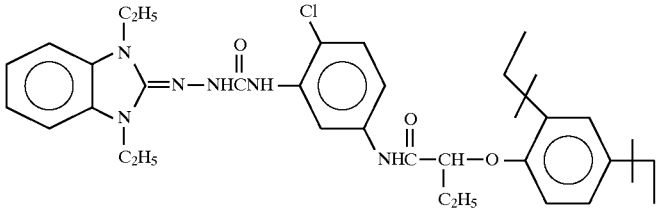
D-51
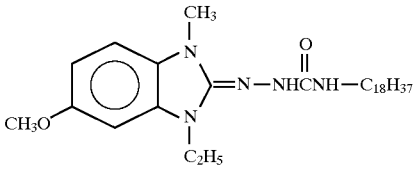
D-52
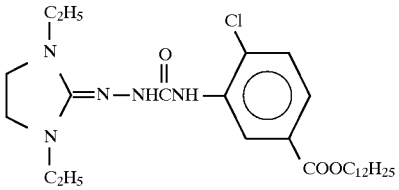
D-53
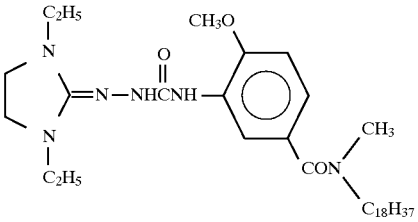
D-54
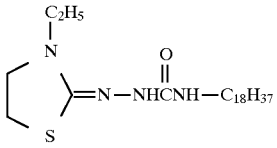
D-55
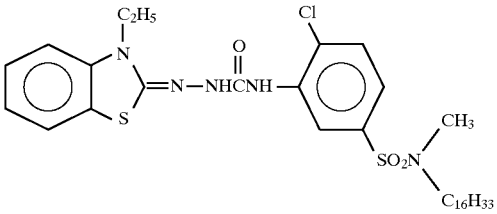
D-56
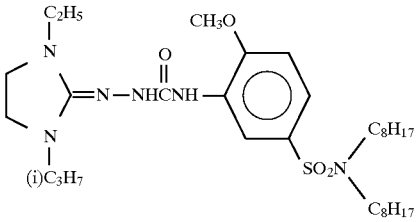
The above compounds can be synthesized by commonly known methods. Pathways for the syntheses are briefly described below.
Synthesis of Developing agent D-2
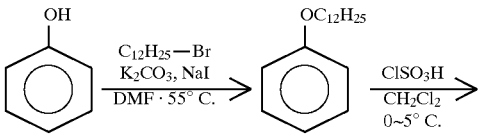
-continued
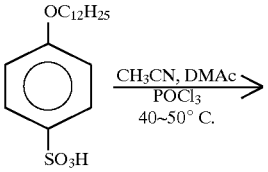

-continued

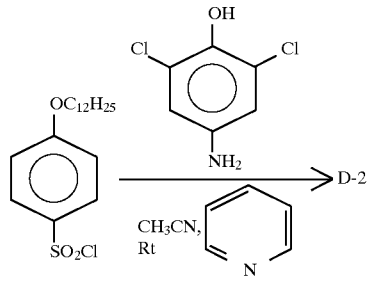

Synthesis of Developing agent D-27

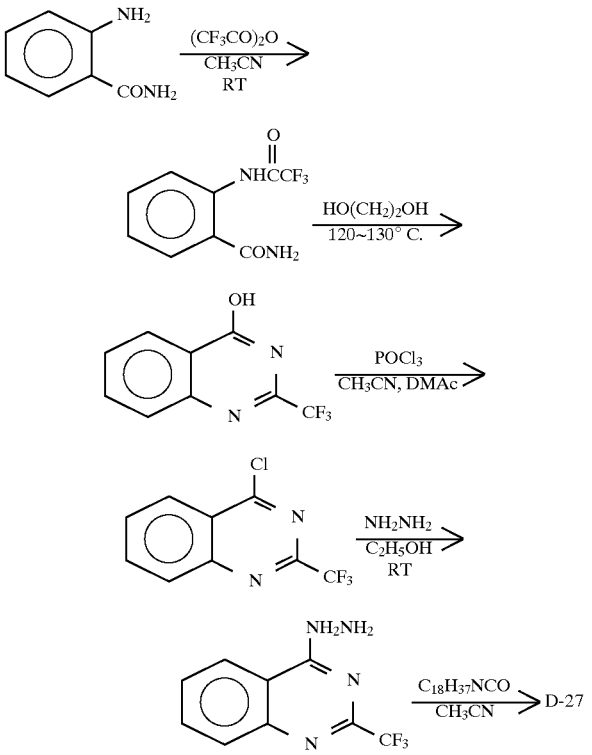

Synthesis of Developing agent D-42

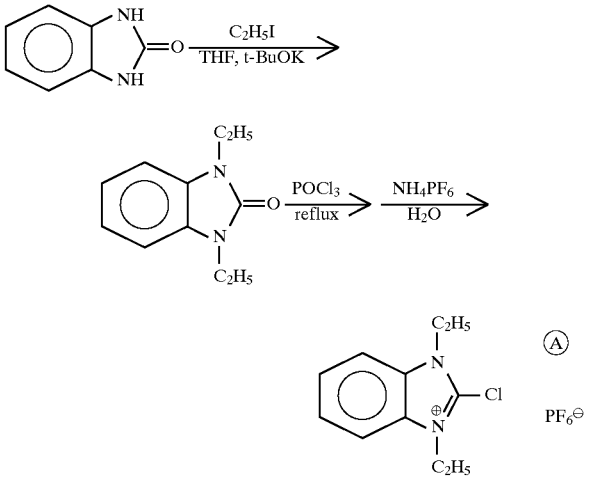

-continued

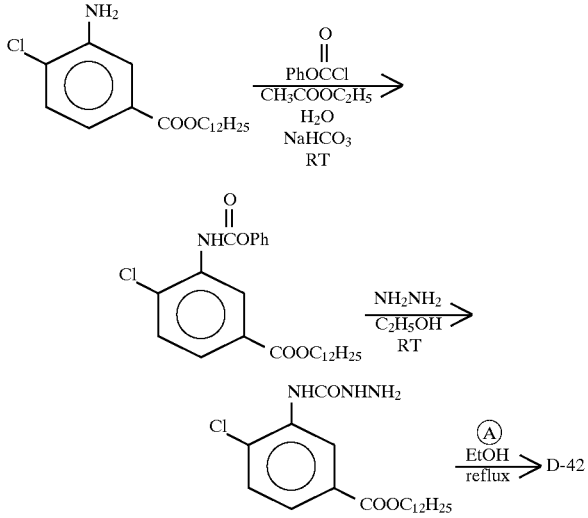

In the case where a nondiffusive developing agent is used, if necessary, an electron transport agent and/or a precursor thereof can be used in the light-sensitive material of the present invention in order to accelerate the transportation of electron between the nondiffusive developing agent and the silver halide which is to be developed. Use of electron transport agents and precursors thereof, which are described in U.S. Pat. No. 5,139,919 and in European Patent Application Laid-Open No. 418,743, is particularly preferred in the present invention. Use of methods for introducing the electron transport agent and/or precursor thereof into a layer in a stable manner, which are described in Japanese Patent Application Laid-Open (JP-A) Nos. 2-230,143 and 2-235,044, is particularly preferred in the present invention.

An electron transport agent or a precursor thereof can be selected from the aforesaid developing agents or precursors thereof. The mobility of the electron transport agent or a precursor thereof is preferably greater than that of a nondiffusive developing agent (electron donor). A particularly useful electron transport agents are 1-phenyl-3-pyrazolidones or aminophenols.

A precursor of electron donor, which is described in Japanese Patent Application Laid-Open (JP-A) No. 3-160,443, is also preferable for use in the light-sensitive material of the present invention.

For such purposes as prevention of color mixing, improvement in the color reproduction and the like, a reducing agent may be used in an intermediate layer or in a protective layer. The reducing agents, which are described in European Patent Application Laid-Open Nos. 524,649 and 357,040 and in Japanese Patent Application Laid-Open (JP-A) Nos. 4-249,245, 2-46,450 and 63-186,240, are particularly preferable for use in the present invention. Also usable are development inhibitor releasing reducers which are described in Japanese Patent Application Publication (JP-B) No. 3-63,733, Japanese Patent Application Laid-Open (JP-A) Nos. 1-150,135,2-46,450, 2-64,634, and 3-43,735 and European Patent Application Laid-Open No. 451,833.

Further, a precursor of a developing agent, which does not have reducing properties per se but which exhibits reducing properties under the influence of a nucleophilic reagent or heat in the process of development, can be used in the light-sensitive material of the present invention.

The light-sensitive material of the present invention can contain any of the following reducing agents, examples of which are the reducing agents and precursors thereof described in U.S. Pat. Nos. 4,500,626, columns 49–50, 4,839,272, 4,330,617, 4,590,152, 5,017,454 and 5,139,919, Japanese Patent Application Laid-Open (JP-A) Nos. 60-140, 335, pp. 17–18, 57-40,245, 56-138,736, 59-178,458, 59-53, 831, 59-182,449, 59-182,450, 60-119,555, 60-128,436, 60-128,439, 60-198,540, 60-181,742, 61-259,253, 62-244, 044, 62-131,253, 62-131,256, 64-13,546, pp. 40–57, and 1-120,553 and European Patent Application Laid-Open No. 220,746A2, pp. 78–96.

Further, a combination of reducing agents, which is disclosed in U.S. Pat. No. 3,039,869, can also be used in the present invention.

The developing agents or the reducing agents may be incorporated in a processing material, which is described later, although they may be incorporated in the light-sensitive material.

The total amount of the developing agent and the reducing agent to be employed in the present invention is in the range of 0.1 to 20 mol, preferably 0.1 to 10 mol, based on 1 mol of silver.

In the present invention, either a 4-equivalent coupler or a 2-equivalent coupler is selected for use depending on the kind of the developing agent. A 4-equivalent coupler is used for the developing agent represented by the formula (I). Since the coupling site of the developing agent represented by the formula (I) is substituted with a sulfonyl group so that the sulfonyl group is eliminated as a sulfinic acid at the time of the coupling reaction, the leaving group which is eliminated from the coupler used together with the developing agent represented by the formula (I) at the time of the coupling reaction should be cationic. Accordingly, although the developing agent represented by the formula (I) reacts with a 4-equivalent coupler which is capable of releasing a proton as a leaving group at the time of coupling reaction, it does not react with a 2-equivalent coupler whose leaving group is anionic. Conversely, a 2-equivalent coupler is used together with the developing agents represented by the formulas (II) or (III). Since the coupling site of the developing agent represented by the formula (II) or (III) is substituted with a carbamoyl group so that the hydrogen atom linked to the nitrogen atom is eliminated as a proton, the leaving group which is eliminated from the coupler used together with the developing agent represented by the formula (II) or (III) at the time of the coupling reaction should be anionic. Accordingly, although the developing agent represented by the formula (II) or (III) reacts with a 2-equivalent coupler which is capable of releasing an anion as a leaving group at the time of coupling reaction, it does not react with a 4-equivalent coupler whose leaving group is a proton. Use of such a combination can prevent color mixing caused by movement of the oxidation product of a developing agent between adjacent layers. Examples of the 4-equivalent couplers and 2-equivalent couplers are described in detail in "Theory of the Photographic Process" (4th edition by T. H. James, Macmillan, 1977), pp. 291–334, pp.354–361, and in Japanese Patent Application Laid-Open (JP-A) Nos. 58-12,353, 58-149,046, 58-149,047, 59-11,114, 59-124,399, 59-174,835, 59-231,539, 59-231,540, 60-2,951, 60-14,242, 60-23,474 and60-66,249in addition to the aforementioned literature and patents.

Hydrophobic additives, such as a coupler, a developing agent and a nondiffusive reducing agent, can be introduced into a layer of a light-sensitive material according to a known method such as the method described in U.S. Pat. No. 2,322,027. In this case, an organic solvent having a high boiling point, which is described in U.S. Pat. Nos. 4,555,470, 4,536,466, 4,536,467, 4,587,206, 4,555,476 and 5,599,296 and in Japanese Patent Application Publication (JP-B) No. 3-62,256, can be used, if necessary, together with an organic solvent having a lower boiling point in the range of 50° to 160° C. Besides these color forming compounds, nondiffusive reducing agents, organic solvents having a high boiling point and the like may be used in a combination of two or more of them, respectively.

The amount of the organic solvent having a high boiling point is 10 g or less, preferably 5 g or less, more preferably in the range of 0.1 to 1 g, based on 1 g of the hydrophobic additives to be used. The amount of the organic solvent having a high boiling point is 1 cc or less, preferably 0.5 cc or less, more preferably 0.3 cc or less, based on 1 g of the binder.

Examples of useful methods for introducing a hydrophobic additive into the layer of a light-sensitive material include a dispersion method utilizing a polymer as described in Japanese Patent Application Publication (JP-B) No. 51-39,853 and Japanese Patent Application Laid-Open (JP-A) No. 51-59,943 and a method wherein a hydrophobic additive, which has been converted into a dispersion of fine grains, is added to the layer as described in Japanese Patent Application Laid-Open (JP-A) No. 62-30,242.

In addition to the above methods, in the case where the hydrophobic additive is a compound substantially insoluble in water, the hydrophobic compound may be dispersed in a binder.

When dispersing a hydrophobic compound to form a hydrophilic colloidal dispersion, a variety of surfactants can be used. For example, surfactants, which are described in Japanese Patent Application Laid-Open (JP-A) No. 59-157, 636, pp. 37–38, and in aforesaid Research Disclosure, can be used. In addition, a phosphoric ester-type surfactant, which is described in Japanese Patent Application Laid-Open (JP-A) Nos. 7-56,267 and 7-228,589 and in German Patent Application Laid-Open No. 1,932,299A, can also be used in the light-sensitive material of the present invention.

The light-sensitive material of the present invention may contain a compound which activates the development and stabilizes the image. Preferred examples of these compounds are described in U.S. Pat. No. 4,500,626, columns 51–52.

A non-light-sensitive layer, such as a protective layer, a prime layer, an intermediate layer, a yellow filter layer and/or an antihalation layer, may be formed between the photographic light-sensitive layers containing silver halide emulsion of the light-sensitive material and/or as a top layer and/or a bottom layer thereof. Further, a supplementary layer, such as a back layer, may be formed on the reverse side of the substrate opposite to the side on which the photographic light-sensitive layer is formed. More specifically, it is possible to form, on the substrate, various layers including the above-mentioned construction, a prime layer described in U.S. Pat. No. 5,051,335, an intermediate layer containing a solid pigment described in Japanese Patent Application Laid-Open (JP-A) Nos. 1-167,838 and 61-20,943, an intermediate layer containing a reducing agent or a DIR compound described in Japanese Patent Application Laid-Open (JP-A) Nos. 1-120,553, 5-34,884 and 2-64, 634, an intermediate layer containing an electron transport layer described in U.S. Pat. No. 5,017,454 and 5,139,919 and in Japanese Patent Application Laid-Open (JP-A) No. 2-235,044 and a protective layer containing a reducing agent described in Japanese Patent Application Laid-Open (JP-A) No. 4-249,245 as well as a combination of two or more of these layers.

A dye, which can be used in a yellow filter layer or in an antihalation layer, is preferably a dye which loses its color or is eliminated at the time of development so that it exerts no influence on the density of image after the process.

That the dye which is present in the yellow filter layer or in the antihalation layer loses its color or is eliminated at the time of development means that the amount of the dye remaining after the process is less than one third, preferably less than one tenth, of the amount of the dye present before the process. This may be attained by a phenomenon wherein the component of the dye is leached out of the light-sensitive material or is transferred into the processing material at the time of development, or by a phenomenon wherein the component of the dye undergoes a reaction and becomes a colorless compound at the time of development.

A known dye can be used in the light-sensitive material of the present invention. For example, employable dyes include a dye, which is soluble in an alkaline solution of a developer, and a dye which becomes colorless as a result of the reaction with an ingredient of the developing solution, sulfite ion, a developing agent or an alkali.

Concrete examples of the dyes include the dye described in European Patent Application EP 549,489A and the dye described in Japanese Patent Application Laid-Open (JP-A) No. 7-152,129, ExF 2–6. A dye which is dispersed in fine solid particles and is described in Japanese Patent Application Laid-Open (JP-A) No. 8-101,487 can also be used. Although this dye can also be used in the case where the light-sensitive material is developed with a processing solution, this dye is particularly suitable to the case where the light-sensitive material is subjected to a hot development utilizing a processing material which is described later.

Further, it is also possible to fix a dye to a mordant and a binder. In this case, the mordant and the dye may be those well known in the field of photography. Examples of the mordants include those described in U.S. Pat. No. 4,500,626, columns 58–59 and in Japanese Patent Application Laid-Open (JP-A) Nos. 61-88,256, pp. 32–41, 62-244,043 and 62-244,036.

Furthermore, it is also possible to use a reducing agent and a compound which reacts with the reducing agent to release a diffusive dye so that the alkali generated at the time of development causes the reaction to release a mobile dye, which will be eliminated either by being dissolved in the processing solution or by being transferred to the processing material. Examples of these compounds and reducing agents are described in U.S. Pat. Nos. 4,559,290 and 4,783,369, European Patent No. 220,746A2, JIII Journal of Technical Disclosure No. 87-6,119 and Japanese Patent Application Laid-Open (JP-A) No. 8-101,487, paragraph 0080–0081.

A leuco dye, which becomes colorless, can also be used in the light-sensitive material of the present invention. For example, Japanese Patent Application Laid-Open (JP-A) No. 1-150,132 discloses a silver halide light-sensitive material containing a leuco dye which is given a color in advance by means of a metal salt of an organic acid as a color developer. Since a complex of a leuco dye and a developer undergoes a reaction by heat or reacts with an alkali to become colorless, the use of the combination of a leuco dye and a color developer in the light-sensitive material of the present invention is desirable if the light-sensitive material of the present invention is to be subjected to a hot development.

In the present invention, a known leuco dye can be used, examples of which are described in Moriga and Yoshida, "Senryo to Yakuhin (Dyes and Chemicals)," vol. 9, pp. 84, Association of Chemical Products, "Shinban Senryo Binran (New Handbook of Dyes)", pp. 242, Maruzen Co., Ltd. (1970), R. Garner, "Reports on the Progress of Applied Chemistry," vol. 56, pp. 199 (1971), "Senryo to Yakuhin (Dyes and Chemicals)", vol. 19, pp. 230, Association of Chemical Products (1974), "Shinkizai (Color Materials),", vol. 62, pp. 288 (1989) and "Senryo Kogyo (Die Industry)," vol. 32, pp. 208. Preferred color developers are a metal salt of an organic acid in addition to acid clay and a phenol/formaldehyde resin. Among metal salts of organic acids, metal salts of salicylic acids, a metal salt of a phenol/salicylic acid/formaldehyde resin, a rhodan salt and a metal salt of xanthogenic acid are preferable. Zinc is particularly preferable among the metals. An oil-soluble zinc salicylate described in U.S. Pat. Nos. 3,864,146 and 4,046,941 and in Japanese Patent Application Publication (JP-B) No. 52-1,327 can be also used as the color developers.

The light-sensitive material of the present invention is preferably hardened by means of a hardener.

Examples of the hardener include those described in U.S. Pat. Nos. 4,678,739, column 41 and 4,791,042, and in Japanese Patent Application Laid-Open (JP-A) Nos. 59-116,655, 62-245,261, 61-18,942 and 4-218,044. More specifically, examples of these hardeners include an aldehyde (e.g., formaldehyde), an aziridine, an epoxy, a vinylsulfone (e.g., N,N'-ethylene-bis(vinylsulfonylacetamide) ethane), a N-methylol compound (e.g., dimethylolurea), boric acid, metaboric acid and a polymeric compound (e.g., a compound described in Japanese Patent Application Laid-Open (JP-A) No. 62-234,157).

The amount of the hardener added is in the range of 0.001 g to 1 g, preferably 0.005 to 0.5 g, based on 1 g of the hydrophilic binder.

The light-sensitive material may contain an anti-fogging agent or a photographic stabilizer as well as a precursor thereof, examples of which include the compounds described in the aforesaid Research Disclosure, U.S. Pat. Nos. 5,089,378, 4,500,627 and 4,614,702, Japanese Patent Application Laid-Open (JP-A) No. 64-13,564, pp. 7–9, pp. 57–71 and pp. 81–97, U.S. Pat. Nos. 4,775,610, 4,626,500 and 4,983,494, Japanese Patent Application Laid-Open (JP-A) Nos. 62-174,747, 62-239,148, 1-150,135, 2-110,557, 2-178,650 and RD 17,643 (1978) pp. 24–25.

The amount of these compounds added is preferably in the range of $5\times10^{-6}$ to $1\times10^{-1}$ mol, more preferably $1\times10^{-5}$ to $1\times10^{-2}$ mol, based on 1 mol of silver.

The light-sensitive material for color photograph of the present invention will be exposed to light and thereafter developed by placing the light-sensitive material and a processing material containing a base and/or a base precursor face to face in the presence of water therebetween in an amount ranging from 1/10 to the equivalent of an amount which is required for the maximum swelling of the total of the coated layers of these materials and heating them.

The present invention has been made in order to realized a superior level of granulation, exposure latitude and discrimination in the above-described hot development, and in order to lessen the adverse environmental influences that accompany the development using a developing solution. The light-sensitive material of the present invention, however, may be developed by means of an activator method utilizing an alkaline processing solution or by means of a developing method utilizing a processing solution containing a developing agent and a base.

A thermal process of a light-sensitive material is well known in the art. For example, a light-sensitive material for hot development and a hot development process are described in "Syashinkogaku no kiso (Fundamentals of Photographic Engineering)", pp. 553–555, Corona Co., Ltd. (1970), "Eizojoho (Image Information)" (April, 1978), pp. 40, "Nablett's Handbook of Photography and Reprography", 7th Ed. (Vna Nostrand and Reinhold Company), pp. 32–pp. 33, U.S. Pat. Nos. 3,152,904, 3,301, 678, 3,392,020 and 3,457,075, U. K. Pat. Nos. 1,131,108 and 1,167,777 and Research Disclosure (June, 1978), pp. 9–15 (RD-17,029).

An activator process means a developing process in which a light-sensitive material containing a color developing agent is treated with a processing solution containing no color developing agent. A feature of the activator process is that the processing solution for the process does not contain a color developing agent which is contained in an ordinary developing solution. The processing solution for the activator process may contain components, such as an alkali and a co-developing agent. Examples of the activator processes are described in publicized literatures such as European Patent Nos. 545,491A1 and 565,165A1.

Methods for developing a light-sensitive material by means of a processing solution containing a developing agent and a base are described in RD Nos. 17,643, pp. 28–29, 18,716, pp. 651, left column to right column, and 307,105, pp. 880–881.

Details of the processing material and processing method to be employed in the hot developing process in the present invention are given below.

The light-sensitive material of the present invention preferably contains a base or a base precursor in order to accelerate the development of silver and the dye forming reaction. Examples of the base precursor include a salt of an organic acid and a base capable of decarboxylation by means of heat and a compound capable of releasing an amine by means of an intramolecular neucleophilic substitution reaction, a Lossen rearrangement or a Beckmann rearrangement. Examples of these compounds are described in U.S. Pat. Nos. 4,514,493 and 4,657,848 as well as in "Known Technologies" No. 5 (issued on Mar. 22, 1991, AZTEC Co., Ltd.), pp. 55–86. In addition, also usable in the present invention is a base generating method in which a combination of a sparingly water-soluble basic metal compound and a compound capable of reacting with the metal contained in the foregoing basic metal compound by use of water as a medium to form a complex compound (hereinafter referred to as a complex forming compound) is used, as described in and European Patent Application Laid-Open No. 210,660 and in U.S. Pat. No. 4,740,445.

The amount of the base or the base precursor to be used in the present invention is in the range of 0.1 to 20 g/m$^2$, preferably 1 to 10 g/m$^2$.

The light-sensitive material of the present invention may contain a thermal solvent, examples of which include polar organic compounds described in U.S. Pat. Nos. 3,347,675 and 3,667,959. Examples of such compounds include amide derivatives (e.g., benzamide), urea derivatives (e.g., methylurea and ethyleneurea), sulfonamide derivatives (e.g., compounds described in Japanese Patent Application Publication (JP-B) Nos. 1-40,974 and 4-13,701), polyol compounds (e.g., a sorbitol and a polyethylene glycol).

Where the thermal solvent is insoluble in water, preferably the thermal solvent is used as a solid dispersion. Depending on the purposes, the thermal solvent may be contained in any of a light-sensitive layer and non-light-sensitive layer.

The amount of the thermal solvent added is in the range of 10 to 500% by weight, preferably 20 to 300% by weight, based on the weight of the binder present in the layer to which the thermal solvent is to be added.

Although the heating temperature of the hot development process is in the range of about 50° to 250° C., the temperature is preferably in the range of 60° to 150° C., more preferably in the range of 60° to 100° C.

In order to supply a base, which is needed for the hot development process, to the light-sensitive material of the present invention, a processing material is used which has a processing layer containing a base or a base precursor. The processing material may have other functions, for example, a function to shut out the air at the time of hot development, a function to prevent the vaporization of the components of the light-sensitive material, a function to supply a material other than the base to the light-sensitive material and a function to remove a component of the light-sensitive material which becomes unnecessary after the development process (e.g., YF dye and AH dye) or an unnecessary component which is formed during the development process. The substrate and binder for the processing material can be the same as those for the light-sensitive material.

The processing material may contain a mordant for the removal of the dye as stated above or for other purpose. The mordant can be any of those known in the field of photography, examples of which include the mordants described in U.S. Pat. Nos. 4,500,626, columns 58–59, and in Japanese Patent Application Laid-Open (JP-A) No. 61-88, 256, pp. 32–41, 62-244,043 and 62-244,036. Further, the processing material can contain a dye acceptor polymeric compound described in U.S. Pat. No. 4,463,079, or the above-mentioned thermal solvent.

The processing layer of the processing material contains a base and/or a base precursor. The base may be either an organic base or an inorganic base. The base precursor may be any of those described hereinabove. The amount of the base or the base precursor to be used in the present invention is in the range of 0.1 to 20 g/m$^2$, preferably 1 to 10 g/m$^2$.

At the time when the light-sensitive material of the present invention undergoes the hot developing process utilizing the processing material, a small amount of water is used for such purposes as acceleration of development, acceleration of the transfer of the processing material, or acceleration of the diffusion of unnecessary substances as described in U.S. Pat. Nos. 4,704,245 and 4,470,445 and in Japanese Patent Application Laid-Open (JP-A) No. 61-238, 056. Such compounds as an inorganic salt of an alkali metal, an organic base, a solvent having a low boiling point, a surfactant, an anti-fogging agent, a compound forming a complex with a sparingly water-soluble metal salt, an anti-mold agent and an antibacterial agent may be added to the water.

The water is not particularly specified, and examples of the water include distilled water, tap water, well water and mineral water. In the hot developing apparatus utilizing the light-sensitive material of the present invention and the processing material, the waste water may be discarded without being reused or may be recycled for repeated use. When using recycled water, the water used accumulates the components leached out of the materials over repeated use. Further, the apparatus and water described in Japanese Patent Application Laid-Open (JP-A) Nos. 63-144,354, 63-144,355, 62-38,460 and 3-210,555 may be used in the present invention.

Water can be supplied to the light-sensitive material or to the processing material or to both of them. The amount of the water to be added ranges from 1/10 to the equivalent of an amount which is required for the maximum swelling of the entire coating layers (not including the back layer) composed of the light-sensitive material and the processing material.

This amount of water indicates an amount which is required at the time of hot development. Accordingly, the scope of the present invention includes a method wherein an amount of water which exceeds the amount specified in the present invention is once added to the light-sensitive material or the processing material and thereafter the excessive water is removed from the light-sensitive material or the processing material by squeeze or other means before placing these materials face to face and the hot development is carried out. Various methods can be adopted as a method of supplying water to these materials. Examples of the methods include a method in which the light-sensitive material or the processing material is passed through a vessel filled with water so that water is absorbed into the hydrophilic colloidal layer, a method in which water is supplied onto the light-sensitive material or the processing material by means of a sponge or felt and a method in which fine droplets of water are sprayed onto the light-sensitive material or the processing material from a head similar to a recording head of an ink jet recording apparatus.

Preferred examples of methods for supplying water to these materials include the methods described in Japanese Patent Application Laid-Open (JP-A) Nos. 62-253,159, pp. 5, and 63-85,544. Further, water in the form of microcapsules or hydrates may be incorporated in advance into the light-sensitive material or the processing material or into both of them.

The temperature of the water to be supplied may be in the range of 30° to 60° C. as described, for example, in Japanese Patent Application Laid-Open (JP-A) No. 63-85,544.

When conducting a hot development of the light-sensitive material in the presence of a small amount of water, it is effective to adopt a method in which a combination of a sparingly water-soluble basic metal compound and a complex forming compound so that a base is generated, as described in and European Patent Application Laid-Open No. 210,660 and in U.S. Pat. No. 4,740,445. In this case, it is desirable to incorporate the sparingly water-soluble basic metal compound in the light-sensitive material and to incorporate the complex forming compound in the processing material, from the viewpoint of the storage stability of the raw materials.

Examples of the heating method in the developing process include a method in which the light-sensitive material is brought into contact with a heated block or plate, a method in which the light-sensitive material is brought into contact with such an object as a hot plate, a hot presser, a hot roller, a hot drum, a halogen lamp heater and an infrared or a far infrared lamp heater, and a method in which the light-sensitive material is passed through a hot atmosphere.

As for the method for placing the light-sensitive material and the processing material face to face so that the light-sensitive layer and the processing layer face each other, the methods, which are described in Japanese Patent Application Laid-Open (JP-A) Nos. 62-253,159 and 61-147,244, pp. 27, can be employed.

For the purpose of processing the light-sensitive material and the processing material of the present invention, any known apparatus for hot development can be used. Preferred examples of the apparatus include the apparatus described in Japanese Patent Application Laid-Open (JP-A) Nos. 59-75, 247, 59-177,547; 59-181,353 and 60-18,951, Japanese Utility Model Application Laid-Open (JP-U) No. 62-25,944 and Japanese Patent Application Laid-Open (JP-A) Nos. 6-130, 509, 6-95,338, 6-95,267, 8-29,955, and 8-29,954.

In addition, commercially available apparatus such as "Pictrostat" 100, 200, 300, 330 and 50 and "Pictrography" 3000 and 2000, manufactured by Fuji Photo Film Co., Ltd. Can be used in the present invention.

The light-sensitive material and/or the processing material of the present invention may have an electroconductive heat generator layer as a heating means for the hot development. For example, a heat generator layer described in Japanese Patent Application Laid-Open (JP-A) No. 61-145, 544 can be used.

In the present invention, although the image information can be read out without removing the silver produced by development, and undeveloped silver halide from the light-sensitive material, it can be read out after removing the silver or silver halide. In the latter case, the silver or silver halide can be removed concurrently with or after the development.

In order to remove the developed silver from the light-sensitive material concurrently with the development or in order to complex or solubilize the silver halide, the processing material may contain a silver oxidizing or re-halogenating agent, which serves as a bleaching agent, and a solvent for the silver halide, which serves as a fixing agent, so that these reactions occur at the time of the hot development.

Further, after the developing process, a second processing material which contains a silver oxidizing or re-halogenating agent or a solvent for the silver halide and the light-sensitive material may be placed face to face in order that the removal of the developed silver or the complexing or solubilizing of the silver halide be carried out.

In the present invention, in so far as the above-mentioned process does not provide adverse effects on the reading out of image information after development, it is preferable that the light-sensitive material be subjected to the above-mentioned process. Since the undeveloped silver halide causes significant haze in gelatin film to an extent that the background density increases, it is preferable to diminish the haze by use of the above-mentioned complexing agent or to solubilize the silver halide so that all or part of the silver halide is removed from the film.

From the viewpoint of reducing haze, it is preferable to use tabular silver halide grains having high aspect ratio or tabular silver halide grains containing silver chloride in high content, as described in the present invention.

In the present invention, a processing material can comprise a commonly used silver bleaching agent. Examples of a silver bleaching agent are described in U.S. Pat. Nos. 1,315,464 and 1,946,640 and in "Photographic Chemistry", vol. 2, chapter 30, Foundation Press, London, England. These bleaching agents effectively oxidize a silver image to make it soluble. Examples of useful silver bleaching agents include an alkali metal salt of dichromic acid and an alkali metal ferricyanide.

Preferred bleaching agents are a water-soluble compound, examples of which include ninhydrin, indandione, hexaketocyclohexane, 2,4-dinitrobenzoic acid, benzoquinone, benzenesulfonic acid and 2,5-dinitrobenzoic acid. The bleaching agents also include an organic complex of a metal, such as an iron (III) salt of cyclohexyldialkylaminetetraacetic acid, an iron (III) salt of ethylenediaminetetraacetic acid and an iron (III) salt of citric acid. The fixing agent can be a solvent for silver halide (i.e., solvent capable of dissolving silver halide) which can be used in the processing material for developing the light-sensitive material (the first processing material). The binder, substrate and other additives usable in the second processing material can also be the same substances as those usable in the first processing material.

The amount of bleaching agent to be added should be determined depending on the amount of silver contained in the light-sensitive material, and is in the range of 0.01 to 10 times, preferably 0.1 to 3 times, and more preferably 0.1 to 2 times the amount (mol) of silver present in the light-sensitive material per unit area.

The solvent for silver halide may be a known compound, examples of which include thiosulfates, such as sodium thiosulfate and ammonium thiosulfate, sulfites, such as sodium sulfite and sodium hydrogen sulfite, thiocyanates, such as potassium thiocyanate and ammonium thiocyanate, thioethers, such as 1,8-di-3,6-dithiaoctane, 2,2'-thiodiethanol, 6,9-dioxa-3,12-dithiatetradecane-1,14-diol as described in Japanese Patent Application Publication (JP-B) No. 47-11,386, a compound having a 5- or 6-membered imido ring, such as urasil and hydantoin as described in Japanese Patent Application Laid-Open (JP-A) No. 8-179,458, and a compound represented by the following general formula (V) as described in Japanese Patent Application Laid-Open (JP-A) No. 53-144,319. A mesoion thiolate compound of trimethyltriazolium thiolate described in "Analytica Chemica Acta", vol. 248, pp. 604 to 614 (1991), is also a preferred compound. A compound which is described in Japanese Patent Application Laid-Open (JP-A) No. 8-69,097 and which is capable of fixing a silver halide to stabilize it can also be used as a solvent for the silver halide. General formula (V)

$$N(R^9)(R^{10})—C(=S)—Y—R^{11}$$

where Y represents a sulfur atom or an oxygen atom. $R^9$ and $R^{10}$, which may be the same or different, each represent an aliphatic group, an aryl group, a heterocyclic group or an amino group. $R^{11}$ represents an aliphatic group or an aryl group. $R^9$ and $R^{10}$ or $R^{10}$ and $R^{11}$ may join together to form a 5-membered or a 6-membered heterocyclic ring. The above-described solvents for the silver halide may be used alone or in a combination of two or more of them.

Among the above-described compounds, a compound having a 5 -membered or 6-membered imido ring, such as urasil or hydantoin, is particularly preferable. The addition of urasil or hydantoin in the form of potassium salt is preferable, because the salt can suppress gloss reduction during the storage of the processing material.

The content of the total amount of the solvent for silver halide in the processing layer is in the range of 0.01 to 100 mmol/$m^2$, preferably 0.1 to 50 mmol/$m^2$, and more preferably 10 to 50 mmol/$m^2$. The total amount of the solvent for the silver halide in the light-sensitive material is in the range of 1/20 to 10 times, preferably 1/10 to 10 times, and more preferably 1/3 to 3 times the amount (mol) of silver present in the light-sensitive material. When using the solvent for silver halide, it may be added to a solvent, such as water, methanol, ethanol, acetone, dimethylformamide or methylpropyl gycol, or to an alkaline or acidic aqueous solution, or otherwise a dispersion comprising fine solid grains of the solvent for the silver halide may be added to a coating solution.

Alternatively, the processing material may contain a physical development nucleus and the solvent for silver halide, so that the solvent for silver halide solubilizes the silver halide contained in the light-sensitive material concurrently with the development and so that the physical development nucleus reduces the soluble silver halide diffused from the light-sensitive material to convert it to physically developed silver which is to be fixed to a processing layer. Any physical development nucleus known as such can be used in the present invention. Examples of the physical development nucleus include colloidal grains of a heavy metal, such as zinc, mercury, lead, cadmium, iron, chromium, nickel, tin, cobalt, copper, and ruthenium, a precious metal, such as palladium, platinum, silver, and gold, a chalcogen compound composed of the foregoing and a substance such as sulfuric acid, selenium or tellurium. These physical development nucleus substances are obtained by reducing a corresponding metal ion utilizing such a reducing agent as ascorbic acid, sodium boron hydride or hydroquinone to produce a colloidal dispersion of metal or by mixing a metal ion with a solution comprising a soluble sulfide, selenide or telluride to produce a colloidal dispersion of insoluble metal sulfide, metal selenide or metal telluride, respectively. These colloidal grains are formed preferably in a hydrophilic binder such as gelatin. The method for preparing colloidal silver grains is described, for example, in U.S. Pat. No. 2,688,601. If necessary, a salt removing process may be conducted in the preparation of the colloidal silver, as is known in a method for preparing silver halide emulsion wherein excessive salt is removed.

The grain diameters of these physical development nuclei are preferably in the range of 2 to 200 nm.

The physical development nuclei are present in an amount ranging normally from $10^{-3}$ to 100 mg/$m^2$, preferably from $10^{-2}$ to 10 mg/$m^2$, in the processing layer.

Although the physical development nucleus may be prepared separately from a coating solution and thereafter the physical development nuclei may be added to the coating solution, the physical development nucleus may be prepared, for example, by the reaction between silver nitrate and sodium sulfide or between silver chloride and a reducing agent in a coating solution containing a hydrophilic binder.

Silver, silver sulfide, palladium sulfide or the like is preferably employed as a physical development nucleus. When using as an image the physically developed silver, which has been transferred to a processing material, it is preferable to use palladium sulfide, silver sulfide and the like, because they have small Dmin and high Dmax values.

Both the first processing material and the second processing material can have at least one timing layer. The timing layer can temporarily retard the bleaching and fixing reaction until the desired reaction among the silver halide, a dye forming compound and a developing agent substantially ends. The timing layer may comprise gelatin, polyvinyl alcohol or a vinyl alcohol/vinyl acetate copolymer. This layer may be a barrier timing layer as described in U.S. Pat. Nos. 4,056,394, 4,061,496 and 4,229,516.

The film thickness of the timing layer is in the range of 5 to 50 $\mu$m, preferably 10 to 30 $\mu$m.

According to the present invention, the light-sensitive material after exposure thereof is bleached and fixed utilizing the second processing material. That is, the process comprises supplying water, in an amount ranging from 1/10 to the equivalent of an amount which is required for the maximum swelling of the total of the light-sensitive material layer and the second processing material layer excepting the back respective layers, to the light-sensitive material or to the second processing material, placing the light-sensitive material and the second processing material so that the light-sensitive layer and processing layer face each other and thereafter heating them to a temperature in the range of 40° to 100° C. for 5 to 60 seconds.

As for the amount of water, kind of water, method of supplying water and method of placing the light-sensitive material and the second processing material face to face, the same as those in the case of the first processing material can be employed.

More specifically, the bleaching and fixing sheets described in Japanese Patent Application Laid-Open (JP-A) No. 59-136,733, U.S. Pat. No. 4,124,398 and Japanese Patent Application Laid-Open (JP-A) No. 55-28,098 can be used in the present invention.

For such purposes as improvement of the coatability, improvement of the releasability, improvement of the slipperiness, prevention of electrostatic charge and acceleration of developing reaction, a surfactant may be added to the light-sensitive material. Examples of the surfactants include those described in "Known Technologies" No. 5 (issued on Mar. 22, 1991, AZTEC Co., Ltd.), pp. 136–138 and in Japanese Patent Application Laid-Open (JP-A) Nos. 62-173,463 and 62-183,457.

For such purposes as prevention of slip, prevention of electrostatic charge and improvement of the releasability, an organic fluorine-containing compound may be added to the light-sensitive material. Typical examples of the organic fluorine-containing compounds include a fluorine-containing surfactant and a hydrophobic fluorine-containing compound, such as an oily fluorine-containing compound, e.g., fluorocarbon oil, and a solid fluorine-containing resin, e.g., tetrafluoroethylene, described in Japanese Patent Application Publication (JP-B) No. 57-9,053, columns 8–17, Japanese Patent Application Laid-Open (JP-A) Nos. 61-20,944 and 62-135,826.

Preferably, the light-sensitive material has a certain level of slipperiness. For this purpose, it is preferable that a slicking agent is contained both in the light-sensitive layer and in the back layer. A preferred level of slipperiness is indicated by a coefficient of dynamic friction in the range of 0.01 to 0.25, which is determined in a test comprising sliding the light-sensitive material at a rate of 60 cm/minute against stainless steel balls having a diameter of 5 mm (25° C., 60% RH). In this test, a value of nearly the same level is obtained even if the stainless steel balls are replaced with a light-sensitive layer.

Examples of usable slicking agents include polyorganosiloxanes, higher aliphatic acid amides, metal salts of higher fatty acid and esters made up of higher fatty acids and higher alcohols. Examples of the polyorganosiloxanes include polydimethylsiloxane, polydiethylsiloxane, polystyrylmethylsiloxane and polymethylphenylsiloxane. The layer to which the slicking agent is added is preferably the outermost light-sensitive layer or the back layer. Polydimethylsiloxane and an ester having a long alkyl chain are particularly preferable.

It is preferable to use an anti-static agent in the present invention. Polymers, which contain carboxylic acid, carboxylic acid salt or a sulfonic acid salt, cationic polymers and ionic surfactants can be used as the anti-static agent.

The most preferred anti-static agent is grains of at least one type of crystalline metal oxide having grain sizes in the range of 0.001 to 1.0 $\mu$m, selected from the group consisting of ZnO, $TiO_2$, $SnO_2$, $Al_2O_3$, $In_2O_3$, $SiO_2$, MgO, BaO, $MoO_3$ and $V_2O_5$ and having a volume resistivity of $10^7$ Ω.cm or less, preferably $10^5$ Ω.cm or less, or grains of a complex oxide thereof, for example, complex of an element such as Sb, P, B, In, S, Si, C and the like and the foregoing metal oxide. The amount of an anti-static agent present in the light-sensitive material is preferably in the range of 5 to 500 mg/m$^2$, more preferably in the range of 10 to 350 mg/m$^2$. The ratio of the electroconductive crystalline oxide or the complex oxide thereof to a binder is preferably in the range of 1/300 to 100/1, more preferably 1/100 to 100/5.

Constituent layers (including back layers) of the light-sensitive material or processing material can contain a polymer latex in order to improve film physical properties such as dimension stability, prevention of curling, prevention of adhering, prevention of film cracking and prevention of pressure-induced sensitization or desensitization. Any and all. polymer latices, which are described in Japanese Patent Application Laid-Open (JP-A) Nos. 62-245,258, 62-136,648 and 62-110,066, can be used in the present invention. Particularly, the utilization of a polymer latex having a low glass transition point (40° C. or less) in the mordant layer of the processing material can prevent cracking of the mordant layer, while the utilization of a polymer latex having a high glass transition point in the back layer of the processing material can prevent curling.

Preferably, the light-sensitive material of the present invention contains a matting agent. Although the matting agent maybe added to either the light-sensitive layer or the back layer, it is particularly preferable that the matting agent be added to the outermost layer on the same side of the substrate as the light-sensitive layer is provided. Although the matting agent may be soluble or insoluble in a processing solution, it is preferable to use a combination of a soluble matting agent and an insoluble matting agent in the present invention. An example of such a combination of matting agents comprises grains of polymethyl methacrylate, poly (methyl methacrylate/methacrylic acid) (in a molar ratio of 9/1 or 5/5) and polystyrene. The matting agent has grain diameters preferably in the range of 0.8 to 10 $\mu$m and preferably has a narrow range of grain diameter distribution. It is preferable that 90% or more of the total number of the grains have a diameter falling in the range of 0.9 to 1.1 times the average grain diameter. Meanwhile, in order to enhance the matting effect, it is also preferable to use fine grains having a grain diameter of 0.8 $\mu$m or less, together with the matting agent having the above-mentioned grain diameter. Examples of fine grains include grains of polymethyl methacrylate (0.2 $\mu$m), grains of poly (methyl methacrylate/methacrylic acid) (in a molar ratio of 9/1, 0.3 $\mu$m ), grains of polystyrene (0.25 $\mu$m) and grains of colloidal silica (0.03 $\mu$m).

Concrete examples of the matting agent are described in Japanese Patent Application Laid-Open (JP-A) No. 61-88,256, pp. 29. Other examples of the matting agent are such materials as benzoguanamine resin beads, polycarbonate beads and AS resin beads, all of which are described in Japanese Patent Application Laid-Open (JP-A) Nos. 63-274,944 and 63-274,952. Further, the compounds which are described in the aforesaid Research Disclosure can be employed as the matting agent.

In the present invention, a substrate for the light-sensitive material and the processing material needs to be able to withstand the processing temperature. Generally, examples of the substrate are paper, a synthetic polymer (film) and the like, as described in "Syashinkogaku no kiso—Ginen Syashin Hen (Fundamentals of Photographic Engineering—Silver Salt Photography Section)", pp. 223–240, edited by Photographic Society of Japan, Corona Co., Ltd., 1979. Concrete examples of the substrate include polyethylene terephthalate, polyethylene naphthalate, polycarbonate, polyvinyl chloride, polystyrene, polypropylene, polyimide and cellulose (e.g., triacetylcellulose).

These materials may be used alone. Further, a substrate in which a synthetic polymer such as polyethylene may be laminated to one side or both sides of paper can be used.

Other substrates, which can be used in the present invention, include those described in Japanese Patent Application Laid-Open (JP-A) Nos. 62-253,159, pp. 29–31, 1-161,236, pp. 14–17, 63-316,848, 2-22,651 and 3-56,955 and U.S. Pat. No. 5,001,033.

Where requirements of resistance to heat and curling are stringent, preferred examples of the substrates are those described in Japanese Patent Application Laid-Open (JP-A) Nos. 6-41,281, 6-43,581, 6-51,426, 6-51,437 and 6-51,442 and in Japanese Patent Application Laid-Open (JP-A) Nos. 6-82,961, 6-82,960, 6-123,937, 6-82,959, 6-67,346, 6-266, 050, 6-202,277, 6-175,282, 6-118,561, 7-219,129and7-219, 144and U.S. Pat. No. 5,326,689.

Also preferable is a substrate mainly made from a styrene-based polymer having a syndiotactic structure.

In order to bond the photographic layer to the substrate, it is preferable that the substrate be surface-treated. Examples of the surface processes include a chemical process, a mechanical process, a corona discharge process, a flame process, an ultraviolet ray process, a high frequency wave process, a glow discharge process, an activated plasma process, a laser process, a mixed acid process and an ozone-oxidation process. Among these surface processes, an ultraviolet irradiation process, a flame process, a corona discharge process and glow discharge process are particularly preferable.

A prime layer may comprise single layer or may comprise two or more layers. Examples of the binder for the prime layer include a copolymer, which is made up of a monomer selected from the group consisting of vinyl chloride, vinylidene chloride, butadiene, methacrylic acid, acrylic acid, itaconic acid, maleic anydride and the like, polyethylene imine, an epoxy resin, grafted gelatin, nitrocellulose and gelatin. Examples of the compound, which swells the substrate, include resorcin and p-chlorophenol. The prime layer may contain a gelatin-hardening agent such as chromates (e.g., chrome alum), aldehydes (e.g., formaldehyde and glutaric aldehdye), isocyanates, active halogen compounds (e.g., 2,4-dichloro-6-hydroxy-s-triazine), an epichlorohydrin resin and active vinylsulfonic compounds. Further, the prime layer may contain $SiO_2$, $TiO_2$, grains of an inorganic material or grains of a copolymer of polymethyl methacrylate (0.01 to 10 $\mu$m) as a matting agent.

In addition, it is preferable to record photographic information and the like by use of a substrate which is provided with a magnetic recording layer and is described in Japanese Patent Application Laid-Open (JP-A) Nos. 4-124,645, 5-40, 321, 6-35,092 and 6-317,875.

A magnetic recording layer is formed by coating onto a substrate an aqueous or organic solvent-based coating solution comprising a binder and magnetic grains dispersed therein.

Examples of usable magnetic grains include ferromagnetic iron oxide such as $\gamma$-$Fe_2O_3$, Co-covered $\gamma$-$Fe_2O_3$, Co-covered magnetite, Co-containing magnetite, ferromagnetic chromium dioxide, ferromagnetic metals, ferromagnetic alloys, hexagonal Ba-ferrite, Sr-ferrite, Pb-ferrite and Ca-ferrite. A Co-covered ferromagnetic iron oxide such as Co-covered $\gamma$-$Fe_2O_3$ is preferable. The shape of the magnetic grains may be selected from the group consisting of needles, grains, spheres, cubes and plates. The specific surface area in $S_{BET}$ is preferably 20 $m^2/g$ or greater, more preferably 30 $m^2/g$ or greater. The saturation magnetization ($\sigma s$) of the ferromagnetics is preferably in the range of $3.0\times10^4$ to $3.0\times10^5$ A/m, more preferably $4.0\times10^4$ to $2.5\times10^5$ A/m. The ferromagnetic grains may be surface-treated with silica and/or alumina or with an organic substance. Further, as described in Japanese Patent Application Laid-Open (JP-A) No. 6-161,032, the ferromagnetic grains may be surface-treated with a silane coupling agent or with a titanium coupling agent. Magnetic grains, which are covered with an inorganic or organic substance and are described in Japanese Patent Application Laid-Open (JP-A) Nos. 4-259, 911 and 5-81,652, can also be used in the present invention.

As described in Japanese Patent Application Laid-Open (JP-A) No. 4-219,569, the binders usable together with the magnetic grains are thermoplastic resin, thermosetting resin, radiation-curable resins, reactive resins, acid-, alkali- or biodegradable polymers, naturally occurring polymers (e.g., cellulose derivatives and derivatives of saccharides) and mixtures thereof. These resins have a Tg in the range of −40° to 300° C. and a weight-average molecular weight in the range of 2,000 to 1,000,000. Preferred examples of the binder include vinyl-based copolymers, cellulose derivatives, such as cellulose diacetate, cellulose triacetate, cellulose acetatepropionate, cellulose acetatebulylate and cellulose tripropionate, acrylic resins, polyvinyl acetal resins and gelatin. Cellulose di(tri)acetate is particularly preferable. The binder may be hardened by use of a crosslinking agent such as an epoxy-type, aziridine-type or isocyanate-type crosslinking agent. Examples of the isocyanate-type crosslinking agent include isocyantes, such as tolylenediisocyanate, 4,4'-diphenylmethanediisocyanate, hexamethylenediisocyanate and xylylenediisocyanate, a reaction product of any of these isocyanates and a polyalcohol (e.g., a tolylenediisocyanate/trimethylol propane in 3/1 molar ratio adduct) and a polyisocyanate produced by a condensation reaction of these isocyanates, all of which are described, for example, in Japanese Patent Application Laid-Open (JP-A) No. 6-59,357.

As described in Japanese Patent Application Laid-Open (JP-A) No. 6-35,092, the aforementioned magnetic grains are dispersed in a binder preferably by means of a kneader, a pin-type mill or an annular mill. A combination of these dispersing means is also preferable. A dispersant, such as the dispersant described in Japanese Patent Application Laid-Open (JP-A) No. 5-88,283 and other known dispersants, may be used in order to disperse the magnetic grains in the binder. The thickness of the magnetic recording layer is in the range of 0.1 to 10 $\mu$m, preferably 0.2 to 5 $\mu$m, and more preferably 0.3 to 3 $\mu$m. The ratio of the weight of the magnetic grains to the weight of the binder is preferably in the range of 0.5:100 to 60:100, more preferably 1:100 to 30:100. The coated weight of the magnetic grains is in the range of 0.005 to 3 $g/m^2$, preferably 0.01 to 2 $g/m^2$, and more preferably 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer may be formed on the entire surface or in a stripe on the reverse side of a photographic substrate by coating or printing the coating solution for forming the magnetic recording layer. Employable methods for forming the magnetic recording layer include an air doctor method, a blade method, an air knife method, squeezing, impregnation, reverse roll coating, transfer roll coating, gravure coating, kissing, casting, spraying, dipping, bar coating and extrusion. The coating solution, which is described, for example, in Japanese Patent Application Laid-Open (JP-A) No. 5-341,436, is preferably used.

The magnetic recording layer may also function in the enhancement of lubrication, control of curling, prevention of electrostatic charge, prevention of adhering and head polishing. Also, another functional layer having any of these functions may be formed. The abrasive grains, which impart a head polishing function to the magnetic recording layer or to another functional layer, preferably contain at least one type of grain having a Moh's hardness of 5 or greater and are non-spherically shaped inorganic grains. Examples of non-spherical inorganic grains include oxides, such as aluminum oxide, chromium oxide, silicon dioxide and titanium dioxide, carbides, such as silicon carbide and titanium carbide, and diamond. The surface of abrasive grains may be treated with a silane coupling agent or with a titanium coupling agent. These grains may be added to the magnetic recording layer. Alternatively, the magnetic recording layer may be overcoated with a coating solution (e.g., a protective layer and lubricating layer) containing these grains. As for the binder in the overcoat, the same binders as those mentioned above may be used, and the binder in the overcoat is preferably the same as that for the magnetic recording layer. The light-sensitive materials having a magnetic recording layer are described in U.S. Pat. Nos. 5,336,589, 5,250,404, 5,229,259 and 5,215,874 and in EP 466,130.

A polyester substrate, which is preferably used in the light-sensitive material having the above-described magnetic recording layer, is described below. Details of the polyester substrate along with a light-sensitive material, a processing procedure, a cartridge and examples in use thereof are shown in JIII Journal of Technical Disclosure No. 94-6,023 (issued on Mar. 15, 1994 from The Japan Institution of Invention and Innovation).

The polyester is made up of a diol and an aromatic dicarboxylic acid. Examples of the aromatic dicarboxylic acid include 2,6-, 1,5-, 1,4- and 2,7-naphthalenedicarboxylic acid, terephthalic acid, isophthalic acid and phthalic acid. Examples of the diol include diethylene glycol, triethylene glycol, cyclohexanedimethanol, bisphenol A and bisphenol. Examples of polymers, which are formed from theses monomers, include homopolymers such as polyethylene terephthalate, polyethylene naphthalate and polycyclohexanedimethanol terephthalate. A polyester, in which 2,6-naphthalenedicarboxylic acid comprises 50 to 100 mol % of the carboxylic acid monomer composition, is preferable, and polyethylene 2,6-naphthalate is particularly preferable. The average molecular weight of the polyester is in the range of about 5,000 to 200,000. Tg of the polyester is 50° C. or greater, preferably 90° C. or greater.

Next, in order to make the polyester substrate low-curling, the polyester substrate is subjected to a heat process at a temperature which is preferably above 40° C. but below Tg, more preferably above (Tg−20)° C. but below Tg. The heat process may be carried out in a continuous manner at a temperature within the above-mentioned range, or it may be carried out discontinuously so that a cooling step is effected between heat-processing steps. The duration of the heat process is preferably in the range of 0.1 to 1,500 hours, more preferably 0.5 to 200 hours. The heat process may be effected while the substrate is held in the shape of a roll, or the heat process may be effected while the substrate is in the shape of a web while being carried. Electroconductive inorganic grains, such as $SnO_2$ and $Sb_2O_5$, may be provided onto the surface of the substrate to impart surface roughness so that the surface condition is improved. Further, it is preferable that the substrate be designed in such a way that the tips of the roll are slightly elevated relative to other parts so that transfer of the cut end mark in the roll core is prevented. Although the heat process may be carried out after film forming, after surface process, after application of back layer (e.g., antistatic agent, slicking agent or the like) and after application of primer, the heat process is carried out preferably after the application of an anti-static agent.

An ultraviolet absorber may be blended into the polyester. Further, in order to prevent light piping, a dye or pigment, commercialized for polyester use under the names of "Diaresin" (from Mitsubishi Chemical Industries, Co., Ltd.) or "Kayaset" (from Nihon Kayaku Co., Ltd.) may be blended into the polyester.

A film patrone (a film case), into which the light-sensitive material of the present invention may be encased, is explained below. The main material of the film patrone may be a metal or a synthetic plastic.

Preferred examples of the plastic material include polystyrene, polyethylene, polypropylene and polyphenyl ether. The film case may contain an anti-static agent, examples of which include carbon black, metal oxide grains, surfactants, such nonionic, anionic, cationic or betaine-based surfactants, and polymers. Examples of the film cases, which have been rendered antistatic, are described in Japanese Patent Application Laid-Open (JP-A) Nos. 1-312,537 and 1-312,538. The resistivity of the film case is preferably $10^{12}$ Ω.cm or less in a condition of 25° C. and 25% RH. Normally, carbon black or a pigment is incorporated into the plastic film case in order to afford shading. The size of the film case may be the 135 size which is currently employed (the diameter of cartridge of the 135 size is 25 mm). For use in a small-sized camera, a film case having a diameter of the cartridge of 22 mm or less may be used. The case volume of the film case is 30 $cm^3$ or less, preferably 25 $cm^3$ or less. The weight of the plastics for a film case is preferably in the range of 5 to 15 g.

A film patrone which feeds out film by the rotation of a spool may be used for the light-sensitive material of the present invention. A film patrone wherein the end of the film is fed from the port of the film patrone to the outside by rotating the spool axis in the direction of the feed of the film can also be used. These film cases are described in U.S. Pat. Nos. 4,834,306 and 5,226,613.

As for the method to form an image on a sheet of color paper or on a light-sensitive material for hot development, the methods, which are described in Japanese Patent Application Laid-Open (JP-A) Nos. 5-241,251, 5-19,364 and 5-19,363, can be used.

EXAMPLES

In order to better explain the present invention, the following examples are given by way of illustration and not by way of limitation.

(Example 1)

A mixture of 0.74 g of gelatin having an average molecular weight of 15,000, 0.7 g of potassium bromide and 930 ml of distilled water was placed in a reactor, and thereafter the temperature of the mixture was raised to 40° C. To this solution, which was vigorously stirred, there were added 30 ml of an aqueous solution containing 1.2 g of silver nitrate and 30 ml of an aqueous solution containing 0.82 g of potassium bromide over a period of 30 seconds. After the completion of the addition, the temperature of the solution was kept at 40° C. for one minute, and then the temperature of the solution was raised to 75° C. Then, 27.0 g of gelatin together with 200 ml of distilled water were added to the solution. Then, 100 ml of an aqueous solution containing 22.5 g of silver nitrate and 80 ml of an aqueous solution containing 15.43 g of potassium bromide were added to the solution in such a manner that the flow rate of the addition was gradually increased over a period of 11 minutes. Then, 250 ml of an aqueous solution containing 75.1 g of silver nitrate and an aqueous solution containing potassium iodide and potassium bromide in a molar ratio of 3:97 (the concentration of potassium bromide:26%) were added to the solution over a period of 20 minutes in such a manner that the flow rate of the addition was gradually increased and that the silver potential after the reaction was −20 mV in opposition to a saturated calomel electrode. Further, 75 ml of an aqueous solution containing 18.7 g of silver nitrate and a 21.9% aqueous solution of potassium bromide were added to the solution over a period of 3 minutes in such a manner that the silver potential after the reaction was 0 mV in opposition to a saturated calomel electrode. After the completion of the addition, the temperature of the solution was kept at 75° C. for one minute, and thereafter the temperature of the solution was decreased to 55° C. Then, 120 ml of an aqueous solution containing 8.1 g of silver nitrate and 320 ml of an aqueous solution containing 7.26 g of potassium iodide were added to the solution over a period of 5 minutes. After the completion of the addition, 5.5 g of potassium bromide and 0.04 mg of potassium hexachloroiridate were added to the solution and the temperature of the solution was kept at 55° C. for one minute. Furthermore, 180 ml of an aqueous solution containing 44.3 g of silver nitrate and 160 ml of an aqueous solution containing 34.0 g of potassium bromide were added to the solution over a period of 8 minutes. After the addition, the temperature of the solution was lowered and the salts were removed from the solution.

The emulsion obtained was made up of hexagonal tabular grains and had an average grain diameter, which was defined as the average diameter of spheres which has equivalent grain volume, of 0.66 $\mu$m and the ratio of the average grain diameter to the average grain thickness of 5.4. This emulsion was designated as Emulsion A-1.

The spectral sensitization and the chemical sensitization of the emulsion was effected by the addition of the following spectrally sensitizing dyes, the compound I, potassium thiocyanate and chloroauric acid and sodium thiosulfate. The value of pAg at the time of chemical sensitization and the amount of chemical sensitizer were adjusted so that the level of the chemical sensitization of the emulsion was optimized.

The green-sensitive emulsion, which was prepared in the above-described procedure, was designated as Emulsion A-1g.

Sensitizing Dye I for green-sensitive emulsion; in an amount of $8.4\times10^{-4}$ mol per mol of silver in Emulsion A-1

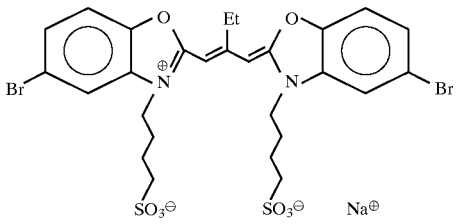

Sensitizing Dye II for green-sensitive emulsion; in an amount of $2.2\times10^{-4}$ mol per mol of silver in Emulsion A-1

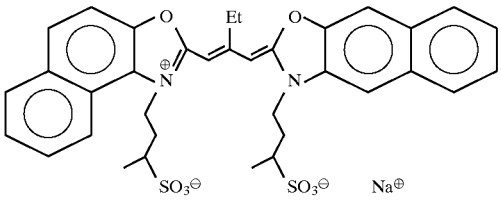

Sensitizing Dye III for green-sensitive emulsion; in an amount of $3.2\times10^{-5}$ mol per mol of silver in Emulsion A-1

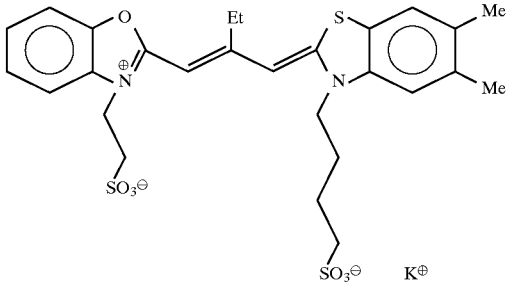

Compound I

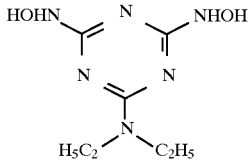

In the following manner, a dispersion of zinc hydroxide as a base precursor was prepared. A mixture, which comprised 31 g of zinc hydroxide powder having an average diameter of primary grains of 0.2 $\mu$m, 1.6 g of carboxymethylcellulose as a dispersant, 0.4 g of sodium polyacrylate, 8.5 g of lime-treated ossein gelatin and 158.5 ml of water, was dispersed for one hour by means of a glass bead mill. After filtering off the glass beads from the mixture, 188 g of a dispersion of zinc hydroxide was obtained.

Next, an emulsified dispersion of a magenta coupler was prepared in the following way.

A mixture, which comprised 7.80 g of magenta coupler (a), 5.45 g of a developing agent (b), 2 mg of an anti-fogging agent (c), 8.21 g of an organic solvent having a high boiling point (d) and 24.0 ml of ethyl acetate, was made into a solution at 60° C. The solution was blended into 150 g of an aqueous solution comprising 12.0 g of a lime-treated gelatin and 0.6 g of a surfactant (e). The resultant mixture was emulsified by means of a dissolver-type mixing device rotating at 10,000 revolutions per minute over a period of 20 minutes. After the emulsification, distilled water was added to the emulsion so that the total volume became 300 g, and the resultant liquid was mixed at 2,000 revolutions per minute for 10 minutes.

Magenta coupler (a):

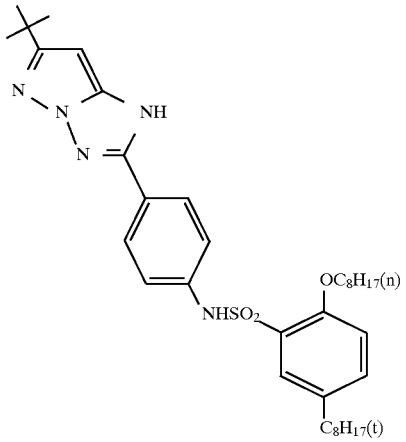

-continued

Developing agent (b):

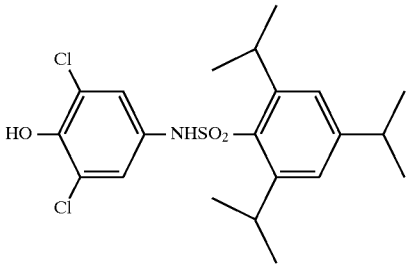

Anti-fogging agent (c):

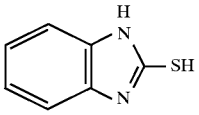

Organic solvent having a high boiling point (d):

-continued

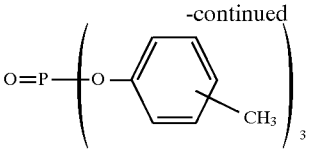

Surfactant (e):

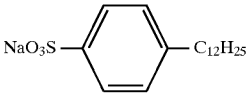

A color photographic light-sensitive material for use in hot development, which was designated as Sample 101, was prepared by the procedure combining the above-described dispersions with the aforedescribed silver halide emulsion to produce the composition as shown in Table 1 and thereafter coating the obtained composition onto a substrate.

TABLE 1

| | Sample 101 | Sample 102 | Sample 103 | Sample 104 | Sample 105 | Sample 106 |
|---|---|---|---|---|---|---|
| Protective layer | | | | | | |
| Lime-treated gelatin | 1000 | 1000 | 1000 | 1000 | 1000 | 1000 |
| Matting agent (silica) | 50 | 50 | 50 | 50 | 50 | 50 |
| Surfactant (f) | 100 | 100 | 100 | 100 | 100 | 100 |
| Surfactant (g) | 300 | 300 | 300 | 300 | 300 | 300 |
| Water-soluble polymer (h) | 15 | 15 | 15 | 15 | 15 | 15 |
| Hardener (i) | 34 | 34 | 34 | 34 | 34 | 34 |
| Intermediate layer | | | | | | |
| Lime-treated gelatin | 375 | 375 | 375 | 375 | 375 | 375 |
| Surfactant (g) | 15 | 15 | 15 | 15 | 15 | 15 |
| Zinc hydroxide | 1100 | 1100 | 1100 | 1100 | 1100 | 1100 |
| Water-soluble polymer (h) | 15 | 15 | 15 | 15 | 15 | 15 |
| Magenta dye forming layer | | | | | | |
| Lime-treated gelatin | 2000 | 2000 | 2000 | 2000 | 2000 | 2000 |
| Emulsion (based on the amount of coated silver) | A-1 g | A-1 g | A-1 g | A-1 g | A-1 g | A-1 g |
| | 1726 | 1726 | 1726 | 1726 | 1726 | 1726 |
| Anti-fogging agent | — | Reference (i) | Reference (ii) | A-6 | A-17 | A-26 |
| | — | 7.65 | 8.77 | 10.13 | 10.69 | 11.26 |
| Magenta coupler (a) | 637 | 637 | 637 | 637 | 637 | 637 |
| Developing agent (b) | 444 | 444 | 444 | 444 | 444 | 444 |
| Anti-fogging agent (c) | 0 | 0 | 0 | 0 | 0 | 0 |

TABLE 1-continued

| | Sample 101 | Sample 102 | Sample 103 | Sample 104 | Sample 105 | Sample 106 |
|---|---|---|---|---|---|---|
| Organic solvent having a high boiling point (d) | 670.00 | 670.00 | 670.00 | 670.00 | 670.00 | 670.00 |
| Surfactant (e) | 33 | 33 | 33 | 33 | 33 | 33 |
| | Transparent PET substrate (120 μm) | | | | | |

*Numerical value indicates a coating weight (mg/m$^2$).

Surfactant (f):

Surfactant (g):

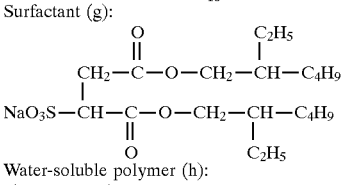

Water-soluble polymer (h):

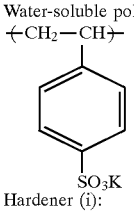

Hardener (i):

$CH_2{=}CH{-}SO_2{-}CH_2{-}SO_2{-}CH{=}CH_2$

Samples 102 to 106 were obtained by repeating the procedure for Sample 101 except that the anti-fogging agent was replaced with 5 kinds of different anti-fogging agents, respectively.

(Table 1)

Reference anti-fogging agents are shown below.

Reference (i)

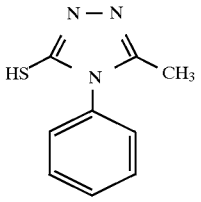

Reference (ii)

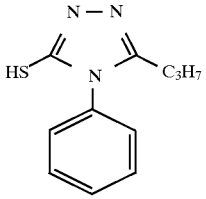

Next, a processing material P-1 of the composition shown in Tables 2 and 3 was prepared.

TABLE 2

Composition of Processing Material P-1

| Constituent layer | Added substance | Amount added (mg/m$^2$) |
|---|---|---|
| 4th layer | Acid-treated gelatin | 220 |
| Protective layer | Water-soluble polymer (j) | 60 |

TABLE 2-continued

Composition of Processing Material P-1

| Constituent layer | Added substance | Amount added (mg/m$^2$) |
|---|---|---|
| | Water-soluble polymer (k) | 200 |
| | Additive (l) | 80 |
| | Palladium sulfide | 3 |
| | Potassium nitrate | 12 |
| | Matting agent (m) | 10 |
| | Surfactant (g) | 7 |
| | Surfactant (n) | 7 |
| | Surfactant (o) | 10 |
| 3rd layer | Lime-treated gelatin | 240 |
| Intermediate layer | Water-soluble polymer (k) | 24 |
| | Hardener (p) | 180 |
| | Surfactant (e) | 9 |
| 2nd layer | Lime-treated gelatin | 2400 |
| Base generating layer | Water-soluble polymer (k) | 360 |
| | Water-soluble polymer (q) | 700 |
| | Water-soluble polymer (r) | 600 |
| | Organic solvent having a high boiling point (s) | 2000 |
| | Additive (t) | 20 |
| | Potassium hydantoin | 260 |
| | Guanidine Picolinic acid | 2910 |
| | Potassium quinolinate | 225 |
| | Sodium quinolinate | 180 |
| | Surfactant (e) | 24 |
| 1st layer | Lime-treated gelatin | 280 |
| Prime layer | Water-soluble polymer (j) | 12 |
| | Surfactant (g) | 14 |
| | Hardener (p) | 185 |
| | Transparent substrate A (63 μm) | |

TABLE 3

Composition of the transparent substrate A

| Name of layer | Composition | Weight ($mg/m^2$) |
|---|---|---|
| Prime layer on the front side | Gelatin | 100 |
| Polymer layer | Polyethylene terephthalate | 62500 |
| Prime layer on the reverse side | Methyl methacrylate/styrene/2-ethylhexyl acrylate/methacrylic acid copolymer | 1000 |
| | PMMA latex (average grain diameter: 12 $\mu$) | 120 |
| | | 63720 |

Water-soluble polymer (j): κ-carrageenan
Water-soluble polymer (k): Sumikagel L-5H (from Sumitomo Chemical Co., Ltd.)
Additive (1):

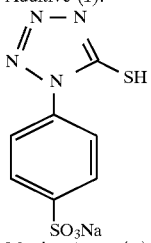

Matting Agent (m): SYLOID 79 (from Fuji-Davison Chemical Co., Ltd.)
Surfactant (n):

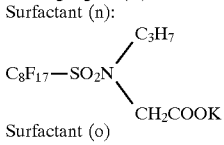

Surfactant (o)

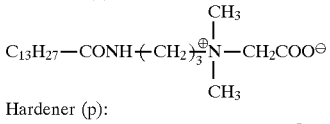

Hardener (p):

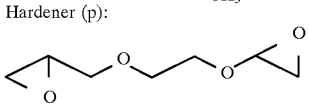

Water-soluble polymer (q): Dextran (molecular weight: 70,000)
Water-soluble polymer (r): MP Polymer MP 102 (from Kuraray Co., Ltd.)
Organic solvent having a high boiling point (s): En-Para 40 (from Ajinomoto Co., Ltd.)
Additive (t):

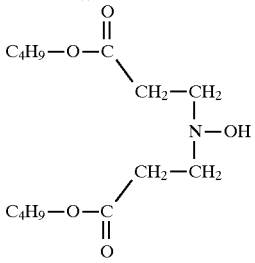

These light-sensitive materials were exposed to the light of 1,000 lux for 1/100 second via an optical wedge and a green filter.

After the exposure, a hot development was carried out by the procedure comprising supplying 15 $ml/m^2$ of warm water at 40° C. to the surface of the light-sensitive material, placing the light-sensitive material and a processing material face to face so that protective layers thereof faced each other and thereafter heating the materials to 83° C. to keep them at that temperature for 25 seconds by use of a heat drum. A wedge-shaped image in a magenta color was obtained in the light-sensitive material when the processing material was removed from the light-sensitive material after the above-described procedure. The colored sample was subjected to a second process by used of a second processing sheet shown in Table 4 indicated below. The procedure of the second process comprised supplying 10 $ml/m^2$ of water to the second processing sheet, placing the second processing sheet and the light-sensitive material, which had undergone the first process, face to face and thereafter heating the materials to 60° C. to keep them at that temperature for 30 seconds.

TABLE 4

| Constituent layer | Added substance | Amount added ($mg/m^2$) |
|---|---|---|
| 4th layer | Acid-treated gelatin | 220 |
| | Water-soluble polymer (j) | 60 |
| | Water-soluble polymer (k) | 200 |
| | Potassium nitrate | 12 |
| | Matting agent (m) | 10 |
| | Surfactant (g) | 7 |
| | Surfactant (n) | 7 |
| | Surfactant (o) | 10 |
| 3rd layer | Lime treated gelatin | 240 |
| | Water-soluble polymer (k) | 24 |
| | Hardener (p) | 180 |
| | Anionic surfactant (3) | 9 |
| 2nd layer | Lime-treated gelatin | 2400 |
| | Water-soluble polymer (k) | 360 |
| | Water-soluble polymer (q) | 700 |
| | Water-soluble polymer (r) | 600 |
| | Organic solvent having a high boiling point (s) | 2000 |
| | Additive A | 1270 |
| | Additive B | 683 |
| | Additive C | 1113 |
| | Surfactant (e) | 20 |
| 1st layer | Gelatin | 280 |
| | Water-soluble polymer (j) | 12 |
| | Surfactant (g) | 14 |
| | Hardener (p) | 185 |
| Substrate | PET substrate A (63 $\mu$m) | |

Additive A

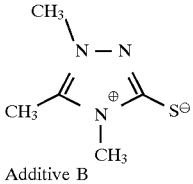

Additive B

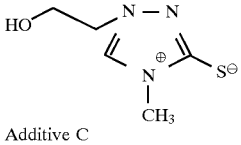

Additive C

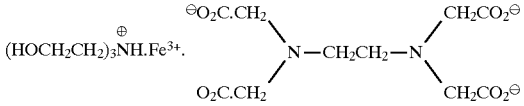

The samples were subjected to the transmission density measurement to obtain characteristic curve. Sensitivity is expressed in a relative value which is 100 times the value obtained as a quotient of the reciprocal of an exposure value, at a density 0.15 higher than fogging density, divided by the reciprocal obtained on the same basis for the Sample 101. The maximum coloration density is used as a criterion of the developability.

These results are shown in Table 5.

TABLE 5

| | Sample 101 | Sample 102 | Sample 103 | Sample 104 | Sample 105 | Sample 106 |
|---|---|---|---|---|---|---|
| Fogging | 0.89 | 0.78 | 0.45 | 0.23 | 0.21 | 0.19 |
| Sensitivity | 100 | 89 | 53 | 93 | 89 | 88 |
| Maximum coloration density | 2.71 | 2.65 | 2.38 | 2.73 | 2.79 | 2.75 |
| Remarks | Comparative example | Comparative example | Comparative example | Example of the present invention | Example of the present invention | Example of the present invention |

The results elucidate the following. Sample 101, which does not contain a mercaptotriazole, exhibits a high level of fogging and the level of the maximum coloration density is somewhat lower. However, Samples 102 and 103, which contain the reference compounds, exhibit a marked decrease in sensitivity although fogging diminishes. In contrast with these samples, Samples 104 to 106, which contain the compounds disclosed in the present invention, exhibit an increase in the maximum coloration density together with a decrease in fogging accompanied by little reduction in sensitivity, thus making it possible to obtain excellent discrimination even with high-temperature, quick development of the light-sensitive material containing a developing agent.

(Example 2)

A mixture of 21.2 g of gelatin having an average molecular weight of 15,000, 0.85g of sodium chloride, 3.8 ml of (1N) sulfuric acid and 1,000 ml of distilled water was placed in a reactor, and thereafter the temperature of the mixture was raised to 40° C. To this solution, which was vigorously stirred, there were added 30 ml of an aqueous solution containing 6.1 g of silver nitrate and 30 ml of an aqueous solution containing 2.00 g of sodium chloride and 0.21 g of potassium bromide over a period of 45 seconds. Then, 40 ml of an aqueous solution containing 0.55 g of potassium bromide was added to the solution. Next, 100 ml of an aqueous solution containing 18.3 g of silver nitrate and 100 ml of an aqueous solution containing 6.30 g of sodium chloride were added to the solution over a period of 3 minutes. After that, 6.0 ml of (1N) sodium hydroxide aqueous solution was added to the solution, and thereafter the temperature of the mixture was raised to 75° C. Then, 10.0 g of gelatin together with 100 ml of distilled water were added to the solution. Then, 750 ml of an aqueous solution containing 145.4 g of silver nitrate and a 7.0% aqueous solution of sodium chloride were added to the solution over a period of 45 minutes in such a manner that the flow rate of the addition was gradually increased and that the silver potential after the reaction was 120 mV in opposition to a saturated calomel electrode. After the completion of the addition, 0.04 mg of potassium hexachloroiridate was added to the solution and the temperature of the solution was kept at 75° C. for 30 minutes. Then, the temperature of the solution was lowered and the salts were removed from the solution. The obtained emulsion comprised silver chloride bromide having a silver bromide content of 0.64%. The emulsion was made up of tabular grains having an average grain diameter, which was defined as the average of diameters of spheres which has equivalent grain volume, of 0.69 μm, a value, indicated as the quotient of the diameter of a circle, which had an area equivalent to the average projected area of a grain, divided by the thickness of the grain, of 7.1 and the plane of projection in a shape of a rectangle having a length to breadth ratio of 1:1.25. The emulsion was designated as Emulsion B-1.

The spectral sensitization and the chemical sensitization of the emulsion was effected in the same way as in Example 1. The sensitized emulsion, which was prepared in the above-described procedure, was designated as Emulsion B-1g.

Six light-sensitive materials, namely, Samples 201 to 206, as shown in Table 6, were prepared by combining Emulsion B-1g with the anti-fogging agents, respectively, as in Example 1.

TABLE 6

| | Sample 201 | Sample 202 | Sample 203 | Sample 204 | Sample 205 | Sample 206 |
|---|---|---|---|---|---|---|
| Protective layer | | | | | | |
| Lime-treated gelatin | 1000 | 1000 | 1000 | 1000 | 1000 | 1000 |
| Matting agent (silica) | 50 | 50 | 50 | 50 | 50 | 50 |
| Surfactant (f) | 100 | 100 | 100 | 100 | 100 | 100 |
| Surfactant (g) | 300 | 300 | 300 | 300 | 300 | 300 |
| Water-soluble polymer (h) | 15 | 15 | 15 | 15 | 15 | 15 |
| Hardener (i) | 34 | 34 | 34 | 34 | 34 | 34 |
| Intermediate layer | | | | | | |
| Lime-treated gelatin | 375 | 375 | 375 | 375 | 375 | 375 |
| Surfactant (g) | 15 | 15 | 15 | 15 | 15 | 15 |
| Zinc hydroxide | 1100 | 1100 | 1100 | 1100 | 1100 | 1100 |
| Water-soluble polymer (h) | 15 | 15 | 15 | 15 | 15 | 15 |
| Magenta dye forming layer | | | | | | |
| Lime-treated gelatin | 2000 | 2000 | 2000 | 2000 | 2000 | 2000 |
| Emulsion (based on the amount of coated silver) | B-1g | B-1g | B-1g | B-1g | B-1g | B-1g |
| | 1726 | 1726 | 1726 | 1726 | 1726 | 1726 |
| Anti-fogging agent | — | Reference (i) | Reference (ii) | A-6 | A-17 | A-26 |
| | — | 13.77 | 15.79 | 18.23 | 19.24 | 20.27 |
| Magenta coupler (a) | 637 | 637 | 637 | 637 | 637 | 637 |
| Developing agent (b) | 444 | 444 | 444 | 444 | 444 | 444 |
| Anti-fogging agent (c) | 0 | 0 | 0 | 0 | 0 | 0 |

TABLE 6-continued

| | Sample 201 | Sample 202 | Sample 203 | Sample 204 | Sample 205 | Sample 206 |
|---|---|---|---|---|---|---|
| Organic solvent having a high boiling point (d) | 670.00 | 670.00 | 670.00 | 670.00 | 670.00 | 670.00 |
| Surfactant (e) | 33 | 33 | 33 | 33 | 33 | 33 |
| Water-soluble polymer (h) | 14 | 14 | 14 | 14 | 14 | 14 |
| | Transparent PET substrate (120 μm) | | | | | |

*Numerical value indicates a coating weight (mg/m$^2$).

The photographic characteristics of these light-sensitive materials were examined in the same way as in Example 1 except that 15 seconds was selected as the time period of hot development. The results are shown in Table 7.

TABLE 7

| | Sample 201 | Sample 202 | Sample 203 | Sample 204 | Sample 205 | Sample 206 |
|---|---|---|---|---|---|---|
| Fogging | 0.97 | 0.86 | 0.39 | 0.28 | 0.25 | 0.21 |
| Sensitivity | 100 | 92 | 41 | 88 | 85 | 81 |
| Maximum coloration density | 2.64 | 2.58 | 2.30 | 2.69 | 2.65 | 2.67 |
| Remarks | Comparative example | Comparative example | Comparative example | Example of the present invention | Example of the present invention | Example of the present invention |

From the results, it can be seen that the present invention inhibited fogging, and enhanced coloration density with little inhibition of sensitivity; characteristics displayed by emulsions having a higher content of silver chloride.

(Example 3)

The following emulsions having different grain sizes and aspect ratios were prepared by repeating the procedure of the preparation of the silver halide emulsion in Example 1 except that the conditions, i.e., temperature for the formation of grains, adding rate of the reactant solutions and the silver potential in the reactor, were changed.

| Name of emulsion | Average grain size (based on spheres of the same volume) | Average aspect ratio (diameter of a circle having an area equivalent to the projected area of a grain ÷ thickness of grain) |
|---|---|---|
| A-1 | 0.66 μm | 5.4 |
| A-2 | 0.87 μm | 7.1 |
| A-3 | 0.37 μm | 3.2 |

The same green-sensitive spectral sensitizing dye and chemical sensitizer as in Example 1 were employed to prepare spectrally sensitized and chemically sensitized green-sensitive emulsions, which were indicated with a suffix g. The amounts of sensitizing dye and the amounts of sensitizer were set to the amounts which most suitably sensitized the respective emulsions. The procedure for the preparation of sensitized emulsions was repeated except that the spectrally sensitizing dye was changed to the dyes indicated below to prepare a blue-sensitized emulsion and a red-sensitized emulsion, which were indicated by a suffix b and a suffix r, respectively. In addition, cyan and yellow coupler dispersions were also prepared in accordance with the procedure for the preparation of the coupler dispersion in Example 1.

Further, in order to form color layers capable of being decolorized at the time of hot development, colorant dispersions were prepared by combining yellow, magenta or cyan leuco dye with color developers.

By use of the resultant silver halide emulsions, coupler dispersions and colorant dispersions, multi-layer structured, hot development, color light-sensitive materials were prepared, as shown in Tables 8, 9 and 10. The compounds employed are shown below. In addition, relative numbers of coated silver halide grains of these samples and values as a quotient of the amount of coated silver divided by (average of projected areas of silver halide grains contained in the emulsion)$^{3/2}$ are shown in Table 11.

TABLE 8

| | Sample 301 | Sample 302 | Sample 303 | Sample 304 |
|---|---|---|---|---|
| Protective layer | | | | |
| Lime treated gelatin | 1000 | 1000 | 1000 | 1000 |
| Matting agent (silica) | 50 | 50 | 50 | 50 |
| Surfactant (f) | 100 | 100 | 100 | 100 |
| Surfactant (g) | 300 | 300 | 300 | 300 |
| Water-soluble polymer (h) | 15 | 15 | 15 | 15 |
| Hardener (i) | 98 | 98 | 98 | 98 |
| Intermediate layer | | | | |
| Lime-treated gelatin | 375 | 375 | 375 | 375 |
| Surfactant (g) | 15 | 15 | 15 | 15 |
| Zinc hydroxide | 1100 | 1100 | 1100 | 1100 |
| Water-soluble polymer (h) | 15 | 15 | 15 | 15 |
| Yellow dye forming layer (highl-sensitive layer) | | | | |
| Lime-treated gelatin | 150 | 150 | 150 | 150 |
| Emulsion (based on the weight of coated silver) | A-2b | A-2b | A-2b | A-2b |
| | 647 | 647 | 647 | 647 |
| Yellow coupler (u) | 57 | 57 | 57 | 57 |
| Developing agent (v) | 41 | 41 | 41 | 41 |
| Anti-fogging agent (w) | 4 | 4 | 4 | 4 |
| Anti-fogging agent | — | Reference (i) | A-17 | A-26 |
| | — | 3.44 | 4.81 | 5.06 |
| Organic solvent having a high boiling point (d) | 50 | 50 | 50 | 50 |
| Surfactant (e) | 3 | 3 | 3 | 3 |
| Water-soluble polymer (h) | 1 | 1 | 1 | 1 |
| Yellow dye forming layer (moderate-sensitive layer) | | | | |
| Lime-treated gelatin | 220 | 220 | 220 | 220 |
| Emulsion (based on the weight of coated silver) | A-1b | A-1b | A-1b | A-1b |
| | 475 | 475 | 475 | 475 |
| Yellow coupler (u) | 84 | 84 | 84 | 84 |
| Developing agent (v) | 60 | 60 | 60 | 60 |
| Anti-fogging agent (w) | 6 | 6 | 6 | 6 |
| Anti-fogging agent | — | Reference (i) | A-17 | A-26 |
| | — | 2.53 | 3.53 | 3.72 |
| Organic solvent having a high boiling point (d) | 74 | 74 | 74 | 74 |
| Surfactant (e) | 4 | 4 | 4 | 4 |

TABLE 8-continued

| | Sample 301 | Sample 302 | Sample 303 | Sample 304 |
|---|---|---|---|---|
| Water-soluble polymer (h) | 2 | 2 | 2 | 2 |
| Yellow dye forming layer (low-sensitive layer) | | | | |
| Lime-treated gelatin | 1400 | 1400 | 1400 | 1400 |
| Emulsion (based on the weight of coated silver) | A-3b | A-3b | A-3b | A-3b |
| | 604 | 604 | 604 | 604 |
| Yellow coupler (u) | 532 | 532 | 532 | 532 |
| Developing agent (v) | 382 | 382 | 382 | 382 |
| Anti-fogging agent (w) | 40 | 40 | 40 | 40 |
| Anti-fogging agent | — | Reference (i) | A-17 | A-26 |
| | — | 3.21 | 4.49 | 4.73 |
| Organic solvent having a high boiling point (d) | 469 | 469 | 469 | 469 |
| Surfactant (e) | 23 | 23 | 23 | 23 |
| Water-soluble polymer (h) | 10 | 10 | 10 | 10 |

TABLE 9

| | Sample 301 | Sample 302 | Sample 303 | Sample 304 |
|---|---|---|---|---|
| Intermediate layer | | | | |
| Lime-treated gelatin | 750 | 750 | 750 | 750 |
| Surfactant (e) | 15 | 15 | 15 | 15 |
| Yellow coloring leuco dye (x) | 303 | 303 | 303 | 303 |
| Color developer (y) | 433 | 433 | 433 | 433 |
| Water-soluble polymer (h) | 15 | 15 | 15 | 15 |
| Magenta dye forming layer (high-sensitive layer) | | | | |
| Lime-treated gelatin | 150 | 150 | 150 | 150 |
| Emulsion (based on the weight of coated silver) | A-2g | A-2g | A-2g | A-2g |
| | 647 | 647 | 647 | 647 |
| Magenta coupler (a) | 48 | 48 | 48 | 48 |
| Developing agent (b) | 33 | 33 | 33 | 33 |
| Anti-fogging agent (c) | 0.02 | 0.02 | 0.02 | 0.02 |
| Anti-fogging agent | — | Reference (i) | A-17 | A-26 |
| | — | 3.44 | 4.81 | 5.06 |
| Organic solvent having a high boiling point (d) | 50 | 50 | 50 | 50 |
| Surfactant (e) | 3 | 3 | 3 | 3 |
| Water-soluble polymer (h) | 1 | 1 | 1 | 1 |
| Magenta dye forming layer (moderate-sensitive layer) | | | | |
| Lime-treated gelatin | 220 | 220 | 220 | 220 |
| Emulsion | A-1g | A-1g | A-1g | A-1g |
| | 475 | 475 | 475 | 475 |
| Magenta coupler (a) | 70 | 70 | 70 | 70 |
| Developing agent (b) | 49 | 49 | 49 | 49 |
| Anti-fogging agent (c) | 0.02 | 0.02 | 0.02 | 0.02 |
| Anti-fogging agent | — | Reference (i) | A-17 | A-26 |
| | — | 2.53 | 3.53 | 3.72 |
| Organic solvent having a high boiling point (d) | 74 | 74 | 74 | 74 |
| Surfactant (e) | 4 | 4 | 4 | 4 |
| Water-soluble polymer (h) | 2 | 2 | 2 | 2 |
| Magenta dye forming layer (low-sensitive layer) | | | | |
| Lime-treated gelatin | 1400 | 1400 | 1400 | 1400 |
| Emulsion | A-3g | A-3g | A-3g | A-3g |
| | 604 | 604 | 604 | 604 |
| Magenta coupler (a) | 446 | 446 | 446 | 446 |
| Developing agent (b) | 311 | 311 | 311 | 311 |
| Anti-fogging agent (c) | 0.14 | 0.14 | 0.14 | 0.14 |
| Anti-fogging agent | — | Reference (i) | A-17 | A-26 |
| | — | 3.21 | 4.49 | 4.73 |

TABLE 9-continued

| | Sample 301 | Sample 302 | Sample 303 | Sample 304 |
|---|---|---|---|---|
| Organic solvent having a high boiling point (d) | 469 | 469 | 469 | 469 |
| Surfactant (e) | 23 | 23 | 23 | 23 |
| Water-soluble polymer (h) | 10 | 10 | 10 | 10 |

TABLE 10

| | Sample 301 | Sample 302 | Sample 303 | Sample 304 |
|---|---|---|---|---|
| Intermediate layer | | | | |
| Lime-treated gelatin | 900 | 900 | 900 | 900 |
| Surfactant (e) | 15 | 15 | 15 | 15 |
| Magenta coloring leuco dye (x) | 345 | 345 | 345 | 345 |
| Color developer (y) | 636 | 636 | 636 | 636 |
| Zinc hydroxide | 1100 | 1100 | 1100 | 1100 |
| Water-soluble polymer (h) | 15 | 15 | 15 | 15 |
| Cyan dye forming layer (high-sensitive layer) | | | | |
| Lime-treated gelatin | 150 | 150 | 150 | 150 |
| Emulsion | A-2r | A-2r | A-2r | A-2r |
| | 647 | 647 | 647 | 647 |
| Cyan coupler (aa) | 65 | 65 | 65 | 65 |
| Developing agent (b) | 33 | 33 | 33 | 33 |
| Anti-fogging agent (c) | 0.03 | 0.03 | 0.03 | 0.03 |
| Anti-fogging agent | — | Reference (i) | A-17 | A-26 |
| | — | 3.44 | 4.81 | 5.06 |
| Organic solvent having a high boiling point (d) | 50 | 50 | 50 | 50 |
| Surfactant (e) | 3 | 3 | 3 | 3 |
| Water-soluble polymer (h) | 1 | 1 | 1 | 1 |
| Cyan dye forming layer (moderate-sensitive layer) | | | | |
| Lime-treated gelatin | 220 | 220 | 220 | 220 |
| Emulsion | A-1r | A-1r | A-1r | A-1r |
| | 475 | 475 | 475 | 475 |
| Cyan coupler (aa) | 96 | 96 | 96 | 96 |
| Developing agent (b) | 49 | 49 | 49 | 49 |
| Anti-fogging agent (c) | 0.05 | 0.05 | 0.05 | 0.05 |
| Anti-fogging agent | — | Reference (i) | A-17 | A-26 |
| | — | 2.53 | 3.53 | 3.72 |
| Organic solvent having a high boiling point (d) | 74 | 74 | 74 | 74 |
| Surfactant (e) | 4 | 4 | 4 | 4 |
| Water-soluble polymer (h) | 2 | 2 | 2 | 2 |
| Cyan dye forming layer (low-sensitive layer) | | | | |
| Lime-treated gelatin | 1400 | 1400 | 1400 | 1400 |
| Emulsion | A-3r | A-3r | A-3r | A-3r |
| | 604 | 604 | 604 | 604 |
| Cyan coupler (aa) | 610 | 610 | 610 | 610 |
| Developing agent (b) | 311 | 311 | 311 | 311 |
| Anti-fogging agent (c) | 0.32 | 0.32 | 0.32 | 0.32 |
| Anti-fogging agent | — | Reference (i) | A-17 | A-26 |
| | — | 3.21 | 4.49 | 4.73 |
| Organic solvent having a high boiling point (d) | 469 | 469 | 469 | 469 |
| Surfactant (e) | 23 | 23 | 23 | 23 |
| Water-soluble polymer (h) | 10 | 10 | 10 | 10 |
| Anti-Halation layer | | | | |
| Lime-treated gelatin | 750 | 750 | 750 | 750 |
| Surfactant (e) | 15 | 15 | 15 | 15 |
| Leuco dye (ab) | 243 | 243 | 243 | 243 425425425425 |
| Water-soluble polymer (h) | 15 | 15 | 15 | 15 |
| Transparent PET substrate (120 μm) | | | | |

*Numerical value indicates a coating weight (mg/m$^2$).

TABLE 11

| | | AG Amount of coated silver ($mg/m^2$) | V Average volume of a grain ($\mu m^3$) | N Relative number of coated grains | S Average of projected areas of silver halide grains ($\mu m^2$) | Ratio of AG to $S^{3/2}$ |
|---|---|---|---|---|---|---|
| Yellow dye-forming layer | A-2b | 647 | 0.3448 | 0.08233 | 1.6758 | 0.03714 |
| | A-1b | 475 | 0.1505 | 0.1385 | 0.8036 | 0.08212 |
| | A-3b | 604 | 0.0265 | 1 | 0.1782 | 1 |

The same relation as above is applicable both to a magenta coloring layer and to a cyan coloring layer.

Sensitizing Dye IV for blue-sensitive emulsion; in an amount of $6.0\times10^{-4}$ mol per mol of silver in Emulsion A-1:

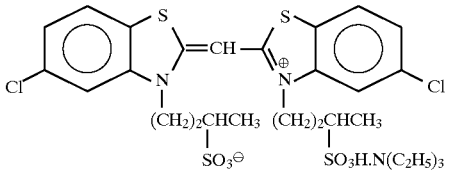

Sensitizing Dye V for red-sensitive emulsion; in an amount of $3.5\times10^{-4}$ mol per mol of silver in Emulsion A-1:

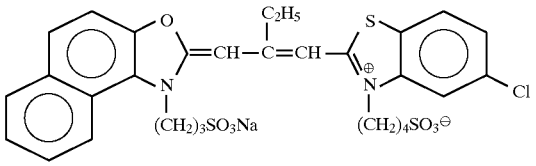

Sensitizing Dye VI for red-sensitive emulsion; in an amount of $1.6\times10^{-5}$ mol per mol of silver in Emulsion A-1:

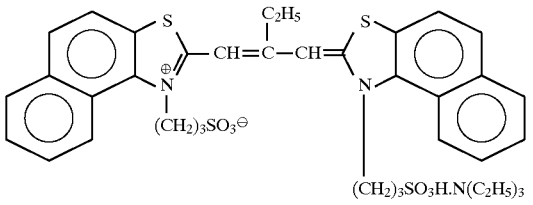

Sensitizing Dye VII for red-sensitive emulsion; in an amount of $5.1\times10^{-4}$ mol per mol of silver in Emulsion A-1:

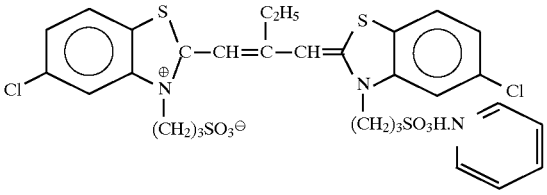

Yellow coupler (u):

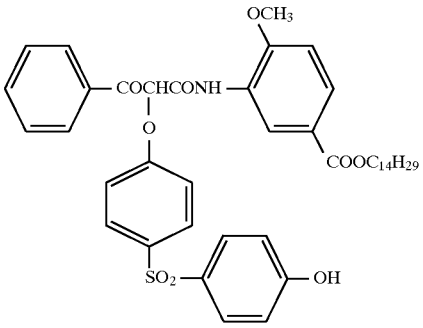

Developing agent (v):

-continued
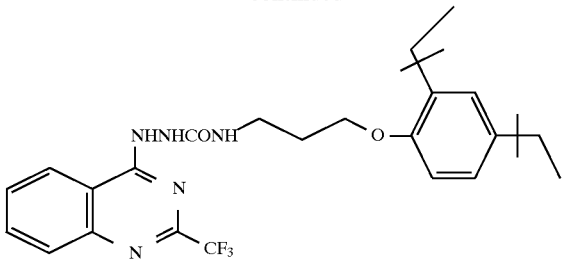
Anti-fogging agent (w):
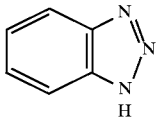
Cyan coupler (aa):
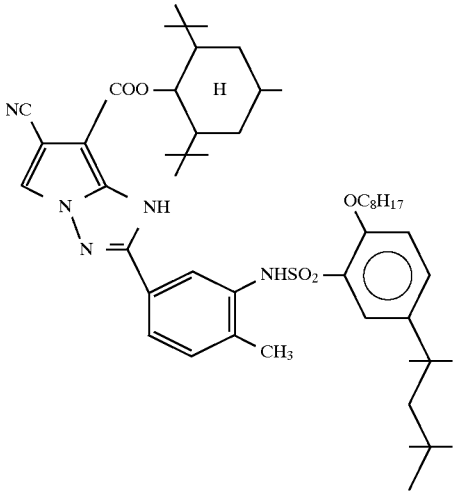
Leuco dye (ab):
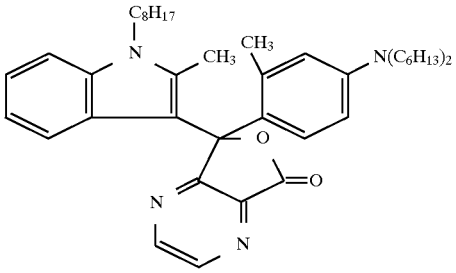
Yellow coloring leuco dye (x):
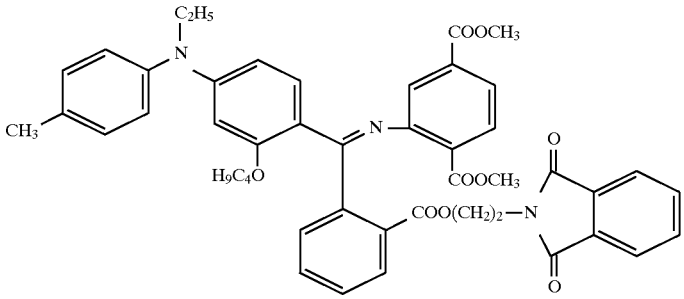

-continued

Color developer (y):

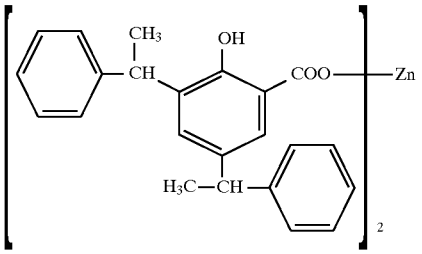

Magenta coloring leuco dye (z):

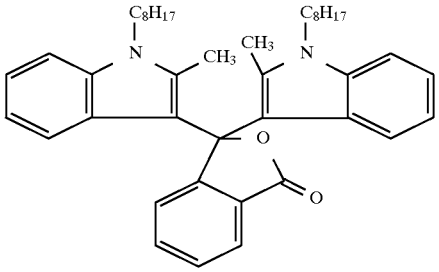

In order to evaluate the photographic characteristics of these light-sensitive materials, the light-sensitive materials were examined in the same way as in Example 1. First, these light-sensitive materials were exposed to the light of 1,000 lux for 1/100 second via an optical wedge and through a blue filter, a green filter or a red filter.

After the exposure, a hot development was carried out by the procedure comprising supplying 15 ml/$m^2$of warm water at 40° C. to the surface of the light-sensitive material, placing the light-sensitive material and the same processing material as that employed in Example 1 so that protective layers faced each other and thereafter heating, by use of a heat drum, the materials to 83° C. to keep them at that temperature for 15 seconds. A yellow wedge-shaped image was obtained when the sample was exposed through the blue filter, a magenta wedge-shaped image was obtained when the sample was exposed through the green filter, and a cyan wedge-shaped image was obtained when the sample was exposed through the red filter, when the processing material was removed from the light-sensitive material after the above-described procedure. The colored samples were subjected to the transmission density measurement to obtain characteristic values as in Example 1. Sensitivity is expressed in a relative value by taking the blue sensitivity, green-sensitivity and red-sensitivity of Sample 301 as 100, respectively.

The results show clearly that the present invention brings about a remarkable effect. In comparison with Sample 301, Sample 302, which contains a reference anti-fogging agent, exhibits a significant reduction in the maximum coloration density and sensitivity, although the level of fogging diminishes. In contrast with these samples, Samples 303 and 304, which contain the compounds disclosed in the present invention, exhibit a low level of fogging, a high-level coloration density and sensitivity together with an excellent discrimination even in the high-temperature, quick development of the light-sensitive material.

(Example 4)

The procedures for the preparation and examination of the multi-layered, color light-sensitive material of Example 3 were repeated except that a substrate, which was prepared in the following way, was used.

1) Substrate

A PEN film having a thickness of 90 μm was obtained by the procedure comprising drying 100 parts by weight of a polyethylene 2,6-naphthalate polymer and 2 parts by weight of Tinuvin P.326 (from Ciba-Geigy Co., Ltd.) as an ultraviolet ray absorber, melting them at 300° C., and extruding through a T-shaped die, stretching the extrudate 3.3 times the original length in the machine direction at 140° C., stretching the extrudate 3.3 times the original length in the trans-

TABLE 12

| | Sample 301 | | | Sample 302 | | | Sample 303 | | | Sample 304 | | |
|---|---|---|---|---|---|---|---|---|---|---|---|---|
| | B | G | R | B | G | R | B | G | R | B | G | R |
| Fogging | 0.75 | 0.69 | 0.65 | 0.58 | 0.53 | 0.51 | 0.23 | 0.20 | 0.19 | 0.22 | 0.18 | 0.17 |
| Sensitivity | 100 | 100 | 100 | 68 | 72 | 70 | 91 | 90 | 90 | 90 | 89 | 88 |
| Maximum Sensitivity | 2.43 | 2.38 | 2.35 | 2.30 | 2.28 | 2.27 | 2.46 | 2.41 | 2.38 | 2.43 | 2.38 | 2.35 |
| Remarks | Comparative Example | | | Comparative Example | | | Example of the present invention | | | Example of the present invention | | |

verse direction at 130° C. and thermally fixing the stretched film at 250° C. for 6 seconds. Prior to the preparation. An appropriate amount of a blue dye, a magenta dye and a yellow dye (I-1, I-4, I-6, I-24, I-26, I-27 and II-5 described in JIII Journal of Technical Disclosure No. 94-6,023) had been added to the PEN film, respectively. The PEN film was wound on a stainless steel core having a diameter of 20 cm and given a thermal hysteresis at 110° C. for 48 hours to produce a low-curling substrate.

2) Application of a prime layer

Both sides of the substrate underwent a sequence of processes comprising a corona discharge process, a UV irradiation and a glow discharge process. Then, a prime layer was formed on both sides by the application of a prime forming solution comprising the following materials: gelatin: 0.1 g/m$^2$, sodium α-sulfo-di-2-ethylhexyl succinate: 0.01 g/m$^2$, salicylic acid: 0.04 g/m$^2$, p-chlorophenol: 0.2 g/m$^2$, $(CH_2{=}CHSO_2CH_2CH_2NHCO)_2CH_2$: 0.012 g/m$^2$, and a polyamide/epichlorohydrin polycondensation product: 0.02 g/m$^2$ (by use of a 10 cc/m$^2$ bar coater) . After the application thereof, the prime layer was dried at 115° C. for 6 minutes (all transportation devices including rollers in the drying zone were kept at 115° C.).

3) Application of back layers

One side of the substrate coated with the above-described prime layer, was coated with an anti-static layer, a magnetic recording layer and a sicking layer, successively as back layers, and having the following compositions.

3-1) Application of an anti-static layer

An anti-static layer was formed by the application of a solution comprising the following materials: a dispersion of fine grains (having an average grain diameter of secondary grains: 0.08 μm) made up of a tin-oxide/antimony-oxide complex oxide having an average grain diameter of 0.005 μm and a resistivity of 5Ω.cm: 0.2 g/m$^2$, gelatin: 0.05 g/m$^2$, $(CH_2{-}CHSO_2CH_2CH_2NHCO)_2CH_2$: 0.02 g/m$^2$, a polyoxyethylene-p-nonylphenol (degree of polymerization: 10): 0.005 g/m$^2$ and resorcinol.

3-2) Application of a magnetic recording layer

A magnetic recording layer having a thickness of 1.2 μm was formed by coating the substrate with cobalt/γ-iron oxide grains coated with 3-polyoxyethylene-propyloxytrimethoxysilane (degree of polymerization: 15) (15 weight percent), having a specific surface area of 43 m$^2$/g, a major axis of 0.14 μm, a minor axis of 0.03 μm, a saturation magnetization of 89 emu/g, $Fe^{+2}/Fe^{+3}$=6/94 and surface-coated with aluminum oxide/silicon oxide in an amount corresponding to 2 weight percent of the iron oxide: 0.06 g/m$^2$, utilizing diacetylcellulose: 1.2 g/m$^2$ (the dispersion of the iron oxide was carried out by means of an open kneader and a sand mill), $C_2H_5C(CH_2OCONH{-}C_6H_3(CH_3)NCO)_3$: 0.3 g/m$^2$ as a hardener together with acetone, methyl ethyl ketone and cyclohexanone as solvents, by use of a bar coater. The following were added to the magnetic recording layer: a matting agent, i.e., silica grains (0.03 μm): 15 mg/m$^2$ and an abrasive, i.e., aluminum oxide grains (0.15 μm) coated with 3-polyoxyethylene-propyloxytrimethoxysilane (degree of polymerization: 15) (15 weight percent): 15 mg/m$^2$. After the application thereof, the magnetic recording layer was dried at 115° C. for 6 minutes (all transportation devices including rollers in the drying zone were kept at 115° C.). The magnetic recording layer exhibited a color density $D_B$ increment under X-light (blue filter) of about 0.1, a saturation magnetization moment of 4.2 emu/g, a coercive force of $7.3\times10^4$ A/m and a polygonal rate of 65%.

3-3) Application of a slicking layer

The substrate was coated with diacetylcellulose (25 mg/m$^2$) together with a mixture of $C_6H_{13}CH(OH)C_{10}H_2OCOOC_{40}H_{81}$ (Compound a: 6 mg/m$^2$) / $C_{50}H_{101}O(CH_2CH_2O)_{16}H$ (Compound b: 9 mg/m$^2$). This coating composition was prepared in the following way: melting the above-mentioned mixture in a blend of xylene/propylene glycol monomethyl ether (1/1) at 105° C., emulsifying the product in propylene glycol monomethyl ether (in an amount 10 times that of the mixture) at room temperature, dispersing the resultant emulsion in acetone to prepare a dispersion (having an average grain diameter of 0.01 μm), and adding the dispersion to the diacetylcellulose. A matting agent, i.e., silica grains (0.3 μm): 15 mg/m$^2$ and an abrasive, i.e., aluminum oxide grains (0.15 μm) coated with 3-polyoxyethylene-propyloxytrimethoxysilane (degree of polymerization: 15) (15 weight percent): 15 mg/m$^2$ were added to the slicking layer. After the application thereof, the slicking layer was dried at 115° C. for 6 minutes (all transportation devices including rollers in the drying zone were kept at 115° C.). The slicking layer exhibited excellent properties characterized by a coefficient of dynamic friction of 0.06 (utilizing a stainless steel hard ball having a diameter of 5 mm and a load of 100 g at a speed of 6 cm/minute), a coefficient of static friction of 0.07 (clip method) and a coefficient of dynamic friction against an emulsion-coated surface of 0.12.

The light-sensitive materials, utilizing the above-described substrate encased in a cartridge, were subjected to the examinations as in the case of other Examples. The test results were excellent and the effects of the present invention were confirmed.

What is claimed is:

1. A silver halide color photographic light-sensitive material which is capable of forming an image by:

after exposing a light-sensitive material, which comprises a first support having thereon at least one photographic light-sensitive layer comprising a light-sensitive silver halide emulsion, a developing agent, a compound capable of forming a dye upon coupling reaction with an oxidation product of the developing agent and a binder;

attaching said light-sensitive material to a processing material, which comprises a second support having thereon a base and/or a base precursor, in such a way that the coated surfaces of the two materials faced each other, in the presence of a small amount of water which corresponds to from 1/10 to 1 time water necessary for giving maximum swelling of all coated layers constituting the light-sensitive material and the processing material; and then heating the light-sensitive material and the processing material, wherein at least one photographic constituent layer contains a compound represented by the formula (A):

Formula (A)

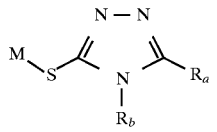

where $R_a$ represents an alkyl group having 4 or more carbon atoms, an aralkyl group having 7 or more carbon atoms, an aryl group having 6 or more carbon atoms or a heterocyclic group having 4 or more carbon atoms; $R_b$ represents an alkyl group, an aralkyl group, an aryl group or a heterocyclic group; and M represents a hydrogen atom, a silver atom or an alkali metal atom.

2. A silver halide color photographic light-sensitive material according to claim 1, wherein at least one said light-sensitive layer contains at least two kinds of silver halide emulsions having spectral sensitivity in the same wavelength region and different average grain projected area in combination such that a ratio of grain number per unit area of an emulsion having larger average grain projected area to that number of an emulsion having smaller average grain projected area is greater than a ratio of the value obtained by dividing the coated silver amount by the $3/2^{nd}$ power of average grain projected area of an emulsion having larger average grain projected area to that value of an emulsion having smaller average grain projected area.

3. A silver halide color photographic light-sensitive material according to claim 1, wherein the developing agent is a compound represented by the formula (I), (II), (III) or (IV):

Formula (I)

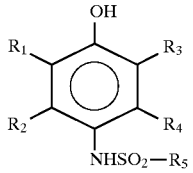

Formula (II)

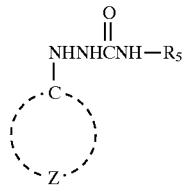

Formula (III)

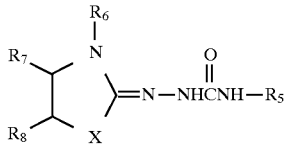

Formula (IV)

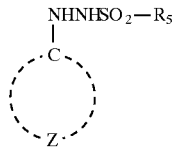

where $R_1$, $R_2$, $R_3$ and $R_4$ each represent a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoly group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents an alkyl group, an aryl group or a heterocyclic group; Z represents a group of atoms forming an aromatic ring such that the total of Hammett's constant σ of the substituents linked thereto is 1 or greater if Z is a benzene ring; $R_6$ represents an alkyl group; X represents an oxygen atom, a sulfur atom, a selenium atom or an alkyl- or aryl-substituted tertiary nitrogen atom; $R_7$ and $R_8$ each represent a hydrogen atom or a substituent or $R_7$ and $R_8$ may join to form a double bond or a ring; and each of the compounds represented by the formulas (I) to (IV) contains at least one ballast group having 8 or more carbon atoms to afford oil-solubility.

4. A silver halide color photographic light-sensitive material according to claim 1, wherein at least one photographic light-sensitive layer comprises a silver halide emulsion containing silver halide grains having a silver chloride content of 50 mol % or more and which are made up of tabular grains having an average aspect ratio of 2 or more such that the main outer surface thereof is composed of a (100) plane and that the plane of projection thereof is in the shape of a rectangle having a length to breadth ratio ranging from 1:1 to 1:2.

5. A silver halide color photographic light-sensitive material according to claim 1, wherein the amount of the compound represented by the formula (A), which is present in the photographic light-sensitive material, ranges from $10^{-6}$ to $10^{-1}$ mol based on 1 mol of the silver contained in the photographic light-sensitive material.

6. A color image forming method, comprising imagewise exposing a silver halide color photographic light-sensitive material, which comprises a substrate and photograph constituent layers formed thereon, said photographic constituent layers comprising at least one light-sensitive layer, said light-sensitive layer containing a light-sensitive silver halide emulsion, a developing agent, a compound which forms a dye by a coupling reaction with an oxidation product of the developing agent, and a binder, at least one photographic light-sensitive layer contains a compound represented by the formula (A) shown below, supplying water to the photographic light-sensitive material or a processing material comprising a substrate and a constituent layer thereon which comprises a processing layer containing a base or a base precursor, in an amount ranging from 1/10 to the equivalent of an amount which is required for the maximum swelling of the all coated layers of these materials, placing the coating surfaces of the light-sensitive material and the processing material face to face, and heating the materials at a temperature of 60° to 100° C. for a period of 5 to 60 seconds to form a color image:

Formula (A)

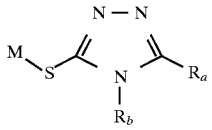

where $R_a$ represents an alkyl group having 4 or more carbon atoms, an aralkyl group having 7 or more carbon atoms, an aryl group having 6 or more carbon atoms or a heterocyclic group having 4 or more carbon atoms; $R_b$ represents an alkyl group, an aralkyl group, an aryl group or a heterocyclic group; and M represents a hydrogen atom a silver atom or an alkali metal atom.

7. A color image forming method according to claim 6, wherein at least one said light-sensitive layer contains at least two kinds of silver halide emulsions having spectral sensitivity in the same wavelength region and different average grain projected area in combination such that a ratio of grain number per unit area of an emulsion having larger average grain projected area to that number of an emulsion having smaller average grain projected area is greater than a ratio of the value obtained by dividing the coated silver amount by the $3/2^{nd}$ power of average grain projected area of an emulsion having larger average grain projected area to that value of an emulsion having smaller average grain projected area.

8. A color image forming method according to claim 6, wherein the developing agent is a compound represented by the formula (I), (II), (III) or (IV):

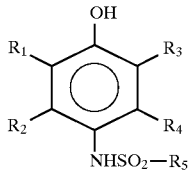

Formula (I)

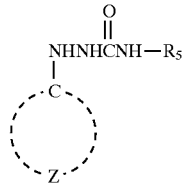

Formula (II)

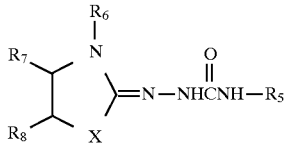

Formula (III)

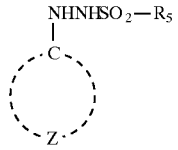

Formula (IV)

where $R_1$, $R_2$, $R_3$ and $R_4$ each represent a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoly group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents an alkyl group, an aryl group or a heterocyclic group; Z represents a group of atoms forming an aromatic ring such that the total of Hammett's constant σ of the substituents linked thereto is 1 or greater if Z is a benzene ring; $R_6$ represents an alkyl group; X represents an oxygen atom, a sulfur atom, a selenium atom or an alkyl- or aryl-substituted tertiary nitrogen atom; $R_7$ and $R_8$ represent each a hydrogen atom or a substituent or $R_7$ and $R_8$ may join to form a double bond or a ring; and each of the compounds represented by the formulas (I) to (IV) contains at least one ballast group having 8 or more carbon atoms to afford oil-solubility.

9. A color image forming method according to claim 6, wherein at least one photographic light-sensitive layer comprises a silver halide emulsion containing silver halide grains having a silver chloride content of 50 mol % or more and which are made up of tabular grains having an average aspect ratio of 2 or more such that the main outer surface thereof is composed of a (100) plane and that the plane of projection thereof is in the shape of a rectangle having a length to breadth ratio ranging from 1:1 to 1:2.

10. A color image forming method according to claim 6, wherein the amount of the compound represented by the formula (A), which is present in the photographic light-sensitive material, ranges from $10^{-6}$ to $10^{-1}$ mol based on 1 mol of the silver contained in the material.

* * * * *